US007161449B2

(12) United States Patent
Satoh et al.

(10) Patent No.: US 7,161,449 B2
(45) Date of Patent: Jan. 9, 2007

(54) COPLANAR WAVEGUIDE RESONATOR

(75) Inventors: Kei Satoh, Yokosuka (JP); Shoichi Narahashi, Yokohama (JP); Daisuke Koizumi, Zushi (JP); Yasushi Yamao, Yokosuka (JP)

(73) Assignee: NTT DoCoMo, Inc., Tokyo (JP)

( * ) Notice: Subject to any disclaimer, the term of this patent is extended or adjusted under 35 U.S.C. 154(b) by 23 days.

(21) Appl. No.: 10/934,463

(22) Filed: Sep. 7, 2004

(65) Prior Publication Data

US 2005/0088259 A1 Apr. 28, 2005

(30) Foreign Application Priority Data

Sep. 5, 2003 (JP) ..... 2003-314396

(51) Int. Cl.
*H01P 1/203* (2006.01)

(52) U.S. Cl. ..... 333/204; 333/219

(58) Field of Classification Search ..... 333/204, 333/219, 246

See application file for complete search history.

(56) References Cited

U.S. PATENT DOCUMENTS

| | | | | |
|---|---|---|---|---|
| 3,967,223 | A * | 6/1976 | McAvoy | 333/219 |
| 4,371,853 | A * | 2/1983 | Makimoto et al. | 333/204 |
| 5,105,173 | A * | 4/1992 | Itou | 333/204 |
| 6,130,189 | A | 10/2000 | Matthaei | |
| 6,262,640 | B1 * | 7/2001 | Tsujiguchi | 333/204 |
| 6,823,201 | B1 * | 11/2004 | Kai et al. | 505/210 |

FOREIGN PATENT DOCUMENTS

| | | |
|---|---|---|
| EP | 0 933 831 A1 | 8/1999 |
| JP | 8-46413 | 2/1996 |
| JP | 9-232820 | 9/1997 |
| JP | 10-290105 | 10/1998 |
| JP | 11-220304 | 8/1999 |
| JP | 2002-330001 | 11/2002 |
| JP | 2002-343877 | 11/2002 |
| WO | WO 01/56107 A1 | 2/2001 |

OTHER PUBLICATIONS

Tatsuya Tsujiguchi, et al., "A Miniaturized End-Coupled Bandpass Filter Using ¾Hair-Pin Coplanar Resonators", IEEE MTT-S Digest, 0-7803-4471-5/98, 1998, pp. 829-832.

Ikuo Awai, et al., "Coplanar Stepped-Impedance-Resonator Bandpass Filter", China Japan Joint Meeting On Microwaves, 2000, pp. 1-4.

Hideyuki Suzuki, et al., "A Low-Loss 5 GHZ Bandpass Filter Using HTS Quarter-Wavelength Coplanar Waveguide Resonators", IEICE Trans. Electron, vol. E85-C, No. 3, Mar. 2002, pp. 714-719.

(Continued)

*Primary Examiner*—Seungsook Ham
(74) *Attorney, Agent, or Firm*—Oblon, Spivak, McClelland, Maier & Neustadt, P.C.

(57) ABSTRACT

A center conductor having a length L1, which is equivalent in electrical length to one quarter wavelength, and ground conductors disposed on the opposite sides of the center conductor with a gap portion therebetween in coplanar manner are formed on a dielectric substrate. The center conductor and the ground conductors located on the opposite sides thereof, and are connected together by shorting ends. This results in the formation of corner areas, respectively, whereby obtaining a coplanar waveguide resonator. An edge line of the shorting end is recessed to have a curve configuration so that each corner area has an angle greater than 90 degrees, which reduces power current concentration at the corner points in the respective corner areas.

15 Claims, 24 Drawing Sheets

OTHER PUBLICATIONS

Xiangying Wu, et al., "Quality Factors of Coplanar Waveguide Resonators", Microwave Conference, XP-010374270, Nov. 30, 1999, pp. 670-673.

Zhewang Ma, et al., "A Low-Loss 5GHz Bandpass Filter Using HTS Coplanar Waveguide Quarter-Wavelength Resonators", Proceedings of the 2002 International Microwave Symposium, XP-001113984, Jun. 2-7, 2002, pp. 1967-1970.

* cited by examiner

COPLANAR WAVEGUIDE RESONATOR

TECHNICAL FIELD

The present invention relates to a coplanar waveguide resonator constructed with a coplanar line and which is used as a resonator or a filter in the transmission and reception of a mobile communication, fixed microwave communication or the like, for example.

BACKGROUND ART

A conventional coplanar waveguide resonator is shown in FIG. 11. Hereinafter the coplanar waveguide resonator may be sometimes called as 'resonator'.

Formed on a dielectric substrate 11 is a center conductor 12*a*, and a pair of ground conductors 13*a* and 13*a*' are formed on the substrate 11 on the opposite sides of the center conductor 12*a* with a gap portion of a spacing 's' therebetween where the dielectric 11 is exposed. At one end of the center conductor 12*a*, one side 212*a* thereof is connected in a short-circuit manner with the ground conductor 13*a* by a shorting end 14*a* while the other side 212*a*' is connected in a short-circuit manner with the ground conductor 13*a*' by a shorting end 14*a*'. The other ends of the ground conductors 13*a* and 13*a*' are connected together by a ground conductor connector 13*con*, and the other end of the center conductor 12*a* is disposed opposite to the ground conductor connector 13#*con* with a spacing g therebetween. While the shorting ends 14*a* and 14*a*' and the ground conductor connector 13*con* are shown as delineated by dotted lines, they are formed integrally with the ground conductors and the center conductor by appearance. The combination of the center conductor 12*a*, the ground conductors 13*a* and 13*a*' and the shorting ends 14*a* and 14*a*' defines a coplanar line having a characteristic impedance which is determined by a ratio of the width w of the center conductor 12*a* to the distance w+2s between the ground conductors 13*a* and 13*a*'. Since the center conductor 12*a* and the ground conductors 13*a* and 13*a*' are formed to be coplanar, it is a simple matter to form the shorting ends 14*a* and 14*a*'. In other words, a microwave circuit using a coplanar line has a greater freedom of design and is more readily manufactured as compared with a microwave circuit using a microstrip line which requires via-holes.

In one example of the coplanar line, the dielectric substrate 11 has a dielectric constant of 9.68. The substrate 11 has a thickness Lc=0.5 mm. The conductor is made of superconducting material and has a thickness Ld=0.5 μm, w=218 μm, and s=91 μm.

The center conductor 12*a* has a length L1 which is electrically equivalent to one-quarter wavelength, and accordingly, a resonance occurs with a high frequency signal which has such a wavelength. In the description to follow, the ground conductors 13*a* and 13*a*' may be generically referred to as a ground conductor 13, and the shorting ends 14*a* and 14*a*' may be generically referred to as a shorting end 14, which is also referred to as a stub.

A plurality of coplanar waveguide resonators may be connected in a cascade connection to form a coplanar filter, as disclosed in a non-patent literature 1: T. TSUJIGUCHI et al. "A Miniaturized End-Coupled Bandpass Filter using λ/4 Hair-pin Coplanar Resonators", p. 829, 1998 IEEE MTT-S Digest; a non-patent literature 2: I. AWAI et al. "Coplanar Stepped-Impedance-Resonator Bandpass Filter", pp. 1–4, 2000 China Japan Joint Meeting On Microwaves; and a non-patent literature 3: H. SUZUKI et al. "A Low-Loss 5 GHz Bandpass Filter Using HTS Quarter-Wavelength Coplanar Waveguide Resonators", pp. 714–719, IEICE TRANS.ELECTRON., VOL. E85-C, NO.3 March 2002.

An example of the coplanar filter constructed with coplanar waveguide resonators of FIG. 11 is shown in FIG. 12A. In this example, four coplanar waveguide resonators 15*a*, 15*b*, 15*c* and 15*d* are formed on a common dielectric substrate 11 and are in cascade connection. The resonators 15*a* and 15*b* share the shorting end 14 in common. Specifically, two ground conductors 13*a* and 13*a*', two shorting ends 14*a* and 14*a*' and the center conductor 12*a* of the resonator 15*a* are in common with two ground conductors 13*a* and 13*a*', two shorting ends 14*b* and 14*b*' and center conductor 12*b* of the resonator 15*b*, forming a so-called foot-to-foot arrangement (inductive coupler) 16*ab* to couple the both resonators. The resonators 15*b* and 15*c* have their open edges of the center conductors 12*b* and 12*c* which are located far from the shorting ends 14*b* and 14*c*, and disposed close and opposite to each other, forming a top-to-top arrangement (capacitive coupler) 17*bc* to couple the both resonators. The resonators 15*c* and 15*d* share ground conductors 13*c*, 13*c*'; and 13*d*, 13*d*'; shorting ends 14*c*, 14*c*'; and 14*d*, 14*d*'; center conductors 12*c* and 12*d* in common, respectively to form the foot-to-foot arrangements (inductive coupler) 16*cd* which couples the both resonators. Thus, the capacitive coupling and the inductive coupling are used in alternate fashion to construct a filter having a bandpass response with four stage resonators. A coplanar line type input section 18 which is coupled to the open end of the resonator 15*a* which is disposed at one end of the cascade connection by a capacitive coupler 17*ia* and a coplanar line type output section 19 which is coupled to the open end of the resonator 15*d* disposed at the other end by a capacitive coupler 17*do* are formed on the dielectric substrate 11 sharing the ground conductors 13 in common. The capacitive couplers 17*ia* and 17*do* which couple between the input section 18 and the output section 19 on one hand and the resonators 15*a* and 15*d* on the other hand have a greater degree of coupling than the capacitive coupler 17*bc* disposed between the resonators 15*b* and 15*c*.

The current density distribution of the filter shown in FIG. 12A which is calculated according to the electromagnetic field simulation using the moment method is shown in FIG. 13. The calculation has been made under the following conditions:

| item | condition |
|---|---|
| input signal | sine wave of voltage 1 Vpp |
| port termination | 50 Ω |
| frequency | 5 GHz |

In this calculation, a simulation is made using coordinate axes shown as X-Y in FIG. 12A. Accordingly, in FIG. 13, a position on the X-axis indicated by $X_0$ corresponds to the input end of the input section 18, and a position indicated by $X_6$ corresponds to the output end of the output section 19. Each of positions $X_1$ to $X_5$ corresponds to the capacitive coupler 17*ia*, the inductive coupler 16*ab*, the capacitive coupler 17*bc*, the inductive coupler 16*cd* and the capacitive coupler 17*do*, respectively.

In each of the resonators 15*a* to 15*d*, the current density distribution is generally sinusoidal having a node at the open end and an antinode at the shorting end 14. It is seen that peaks in the current density distribution occurs at the coupler

16*ab* between the resonators 15*a* and 15*b* and the coupler 16*cd* between the resonator 15*c* and 15*d*, namely at locations where the sinusoidal current density distribution has maxima. This is because a current concentration occurs at the respective edge lines, namely the edge line 112*a* (see FIG. 12B) of intersections between the lateral side surface and the top surface of the center conductor 12*a*, the edge line 113*a* (see FIG. 11) between the lateral side surface 13*a*0 and the top surface of the ground conductor 13*a* and the edge line 20*a* between the lateral side surface 14*a*0 (see FIG. 11) and the top surface of the shorting end 14*a*, which is a so-called edge effect, and also because a current concentration further occurs at the corner area 21*a*1 and 21*a*2 (indicated as encircled by dotted lines in FIGS. 12A and 12B) since they have an angle of 90° formed between the edge line 20*a* which is viewed as a straight line in plan view of FIGS. 12A and 12B of the shorting end 14*a* and the edge line 112*a* of the center conductor 12*a* or the edge line 113*a* of the ground conductor 13*a* which is also viewed in the plan view.

The shorting end 14*a* which shorts the center conductor 12*a* to the ground conductor 13*a* is defined here to have the edge line 20 of a rectilinear configuration toward the dielectric. As seen from FIG. 11, the shorting end 14*a* has a lateral side surface 14*a*0 that have a height equal to the thickness of the conductor film by a length 's' and a top surface. These surfaces intersect together with an edge line 20*a* therebetween. The lateral side surface 14*a*0 faces toward the gap portion of a spacing 's' formed between the center conductor 12*a* and the ground conductor 13*a* where the dielectric 11 is exposed. The edge line 20*a* is seen as a straight line viewed in a plan view of FIG. 12B, thus it is defined the edge line toward the dielectric of the shorting edge 14*a*. Other edge line 112*a* of the center conductor 12*a* and still other edge line 113*a* of the ground conductor 13*a* are also seen straight lines in the plan view, thus they are fined in the same manner as being toward the dielectric. Any edge line other than those mentioned above is defined in the same manner as being toward the dielectric.

In order to consider the operation of the coupler 16*ab*, a combination of the two resonators 15*a* and 15*b* as shown in FIG. 12B (driver is not shown) is taken out from the filter shown in FIG. 12A. An exemplary current density distribution at one shorting end 14*a* of one resonator 15*a* is determined by a simulation as mentioned above on the basis of the construction shown in FIG. 12B in which a connecting portion 13*con* is provided between the ground conductors 13*a* and 13*a*, and a result of the simulation is shown in FIG. 14.

In FIG. 14, the calculation is based on the coordinate axes indicated by x-y axes as shown in FIG. 12B. Position $y_A$ on the y-axis corresponds to the position of a straight line 113*a* which represents an edge line toward the dielectric 11 of the ground conductor 13*a*, and position $y_B$ corresponds to the position of a straight line 112*a* which represents an edge line toward the dielectric of the center conductor 12*a* of the resonator 15*a*. Position $x_A$ on the x-axis corresponds to the position of a straight line 20*a* which represents an edge line toward the dielectric of the shorting end 14*a*.

It will be evident from FIG. 14 that sharp peaks occur in the current density distribution at the respective corner points (bends) of the corner areas 21*a*1 and 21*a*2 and a maximum current density of 1365.5 A/m occurs at the corner point 121*a*2 of the corner area 21*a*2 where the shorting end 14*a* and the center conductor 12*a* are connected. It is to be noted that the current density distribution at the corner points of two other corner areas 21*a*2', 21*a*1' of the other shorting end 14*a*'(only indicated as encircled by dotted lines) is omitted from illustration in FIG. 14. The origin for the x axis and the y axis is as shown in FIG. 12B.

It is to be noted while a corner area has been generically referred to as 21 in the above description, postfix letters are used in FIG. 12A in order to identify a particular corner area. The same principle applies in the description to follow when a particular one is specifically identified.

The corner area 21*a*1 is formed by the intersection of the straight line 20*a* which represents an edge line toward the dielectric of the shorting end 14*a* and a straight line 113*a* which represents an edge line toward the dielectric of the ground conductor 13*a* of the resonator 15*a* at the corner point 121*a*1, and has an angle θ1 formed between the both straight lines, and the angle θ1 is 90° toward the dielectric. The corner area 21*a*2 is formed by the intersection of the edge line 20*a* toward the dielectric of the shorting end 14*a* and a straight line 112*a* which represents an edge line toward the dielectric of the center conductor 12*a* at the corner point 121*a*2, and has an angle θ2 formed between the both straight lines, and the angle θ2 is 90° toward the dielectric. Similarly, the other shorting end 14*a*' which shorts the center conductor 12*a* and the ground conductor 13*a*' of the resonator 15*a* has an edge line which forms an angle θ2' of 90° toward the dielectric with the edge line toward the dielectric of the center conductor 12*a* and an angle θ1' of 90° toward the dielectric with the edge line toward the dielectric of the ground conductor 13*a'*.

It is stipulated here that an angle of such a corner area which is referred to hereafter refers to an angle toward the dielectric which is exposed at the gap portion.

In a conventional coplanar resonator, because the corner area of the shorting end has an angle of 90°, a sharp peak occurs at the corner points of the shorting end 14 where the current density distribution has its maximum, and this has been a cause of an increased power loss.

In the coplanar resonator in which the conductor is formed of a superconducting material, there is a critical current level which is inherent to the superconducting material, and even though the resonator were cooled to a temperature below a critical temperature, the superconducting state will be destroyed if a current which exceeds a critical current density flows through a portion thereof.

DISCLOSURE OF THE INVENTION

It is an object of the present invention to provide a coplanar resonator in which a maximum current density which occurs in a coplanar resonator including shorting ends is reduced to avoid an increase in the power loss, and to provide a coplanar resonator which blocks the destruction of the superconducting state when a superconducting material is used to form the conductors.

In accordance with the invention, in a coplanar waveguide resonator including shorting ends, a corner area defined between the center conductor and the shorting end, and another corner area defined between the ground conductor and the shorting end are formed so that a pair of adjoining edge lines which form each of the corner areas form an angle greater than 90° toward the dielectric.

In addition, in accordance with the present invention, each shorting end has an edge line toward the dielectric which is nonlinear and which is recessed into the shorting end.

BEST MODES FOR CARRYING OUT THE INVENTION

Figure 11:
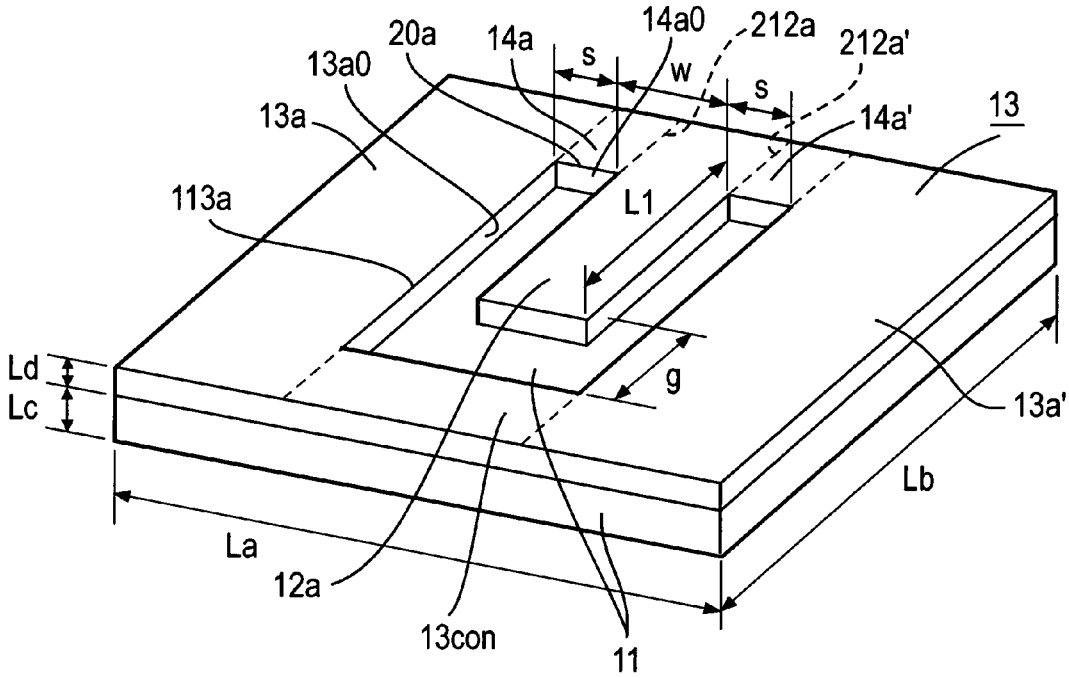
FIG.11 PRIOR ART
FIG. 11 is a perspective view of a conventional coplanar waveguide resonator.

Referring to the drawings, several embodiments of the invention will now be described. It is to be understood that throughout the drawings, parts corresponding to those shown in FIGS. 11 and 12 are designated by like reference characters as used before.

Embodiment 1

Figure 12A:
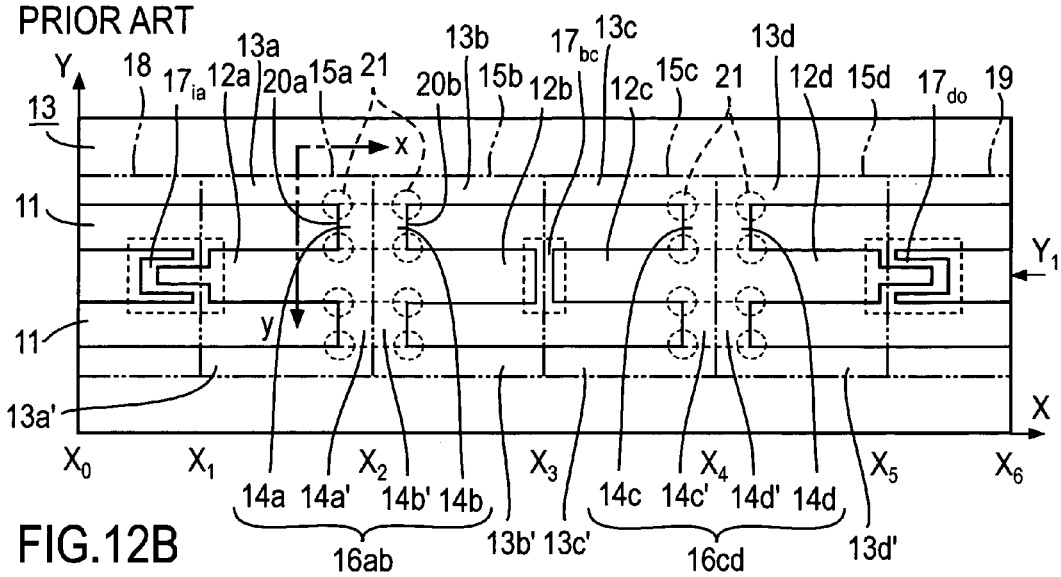
FIG.12A PRIOR ART
FIG. 12A is a plan view of a conventional coplanar filter.
Figure 12B:
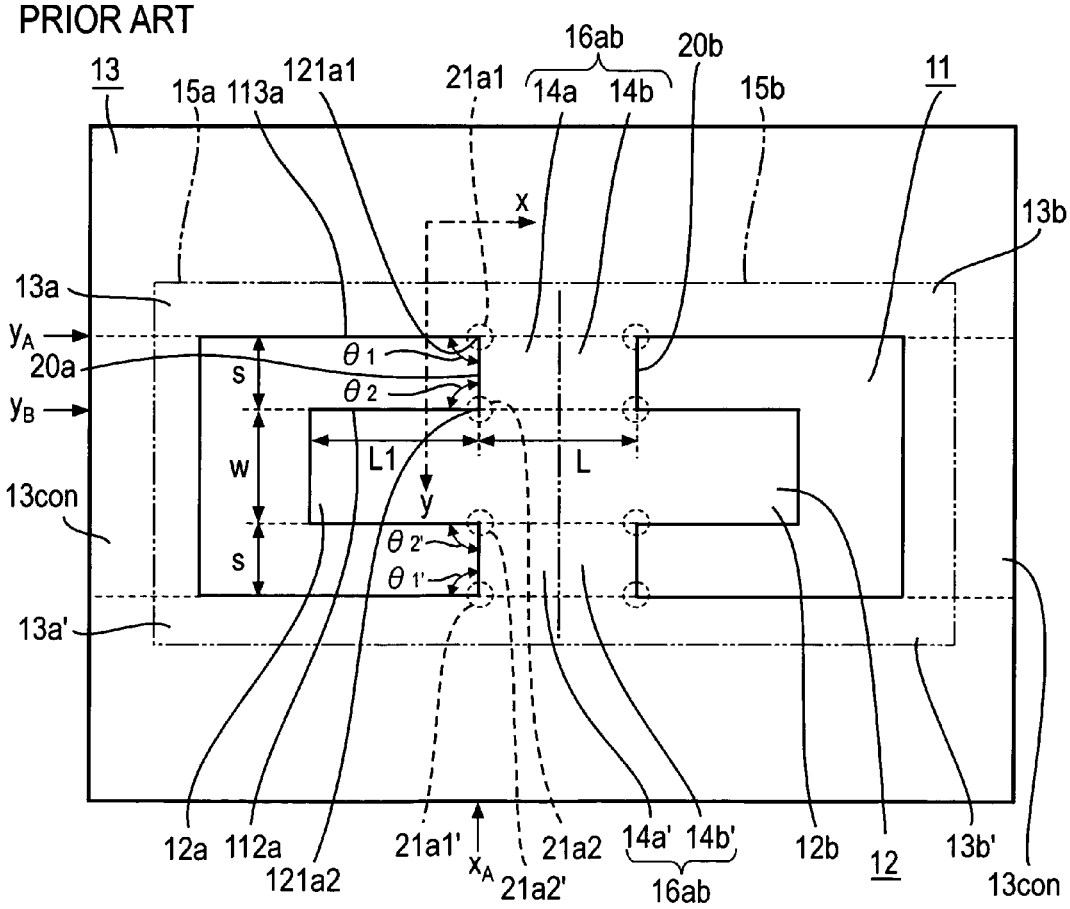
FIG.12B PRIOR ART
FIG. 12B is a plan view of a combination of the conventional coplanar waveguide resonators taken out of the coplanar filter of FIG. 12A.
Figure 13:
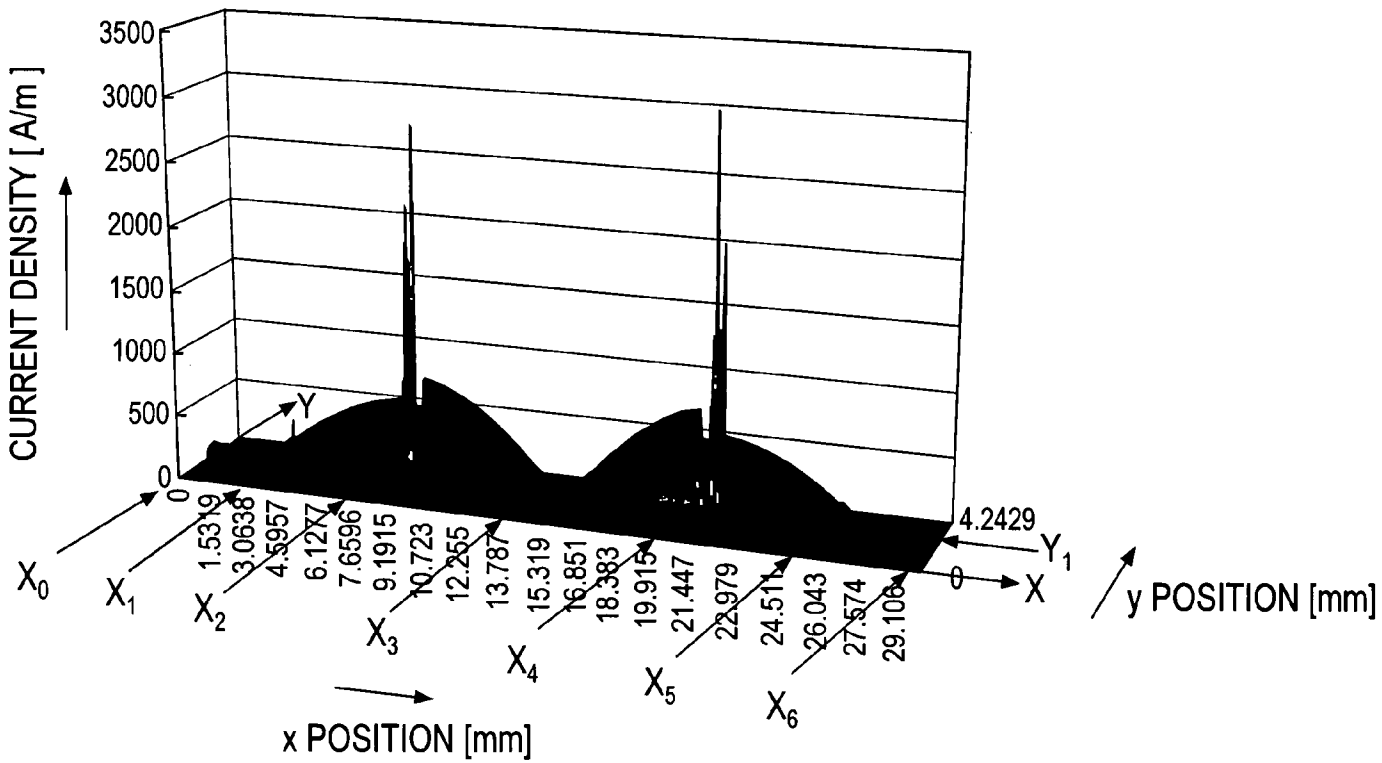
FIG.13 PRIOR ART
FIG. 13 graphically shows a current density distribution in one of the conventional coplanar waveguide resonators shown in FIG. 12B.

It is found from a consideration of a conventional example that when attention is paid to the shorting end 14*a* which shorts the center conductor 12*a* of the resonator 15*a* shown in FIG. 12B to the ground conductor 13*a*, because an edge line 20*a* toward the dielectric of the shorting edge 14*a* is configured to be rectilinear, two corner areas 21*a*1 and 21*a*2 each have an angle θ1 or θ2 of 90°, as mentioned above, thereby causing a concentration of the current.

To eliminate this disadvantage, in accordance with the present invention, the two corner areas are made to have an angle greater than 90°. An edge line toward the dielectric of a shorting end of this embodiment 1 which joins between corner points of the two corner areas is configured to be nonlinear and recessed into the shorting end.

It is noted that a curve is composed of and equivalent to a number of minimum length piecewise-linear straight lines which are consecutively disposed one after another. Accordingly, as a specific example of two edge lines which form a corner area and which defines an angle greater than 90° toward the dielectric, an embodiment will be described in which the edge line of the shorting end is defined as a curved configuration having a continuous differential coefficient.

Figure 1A:
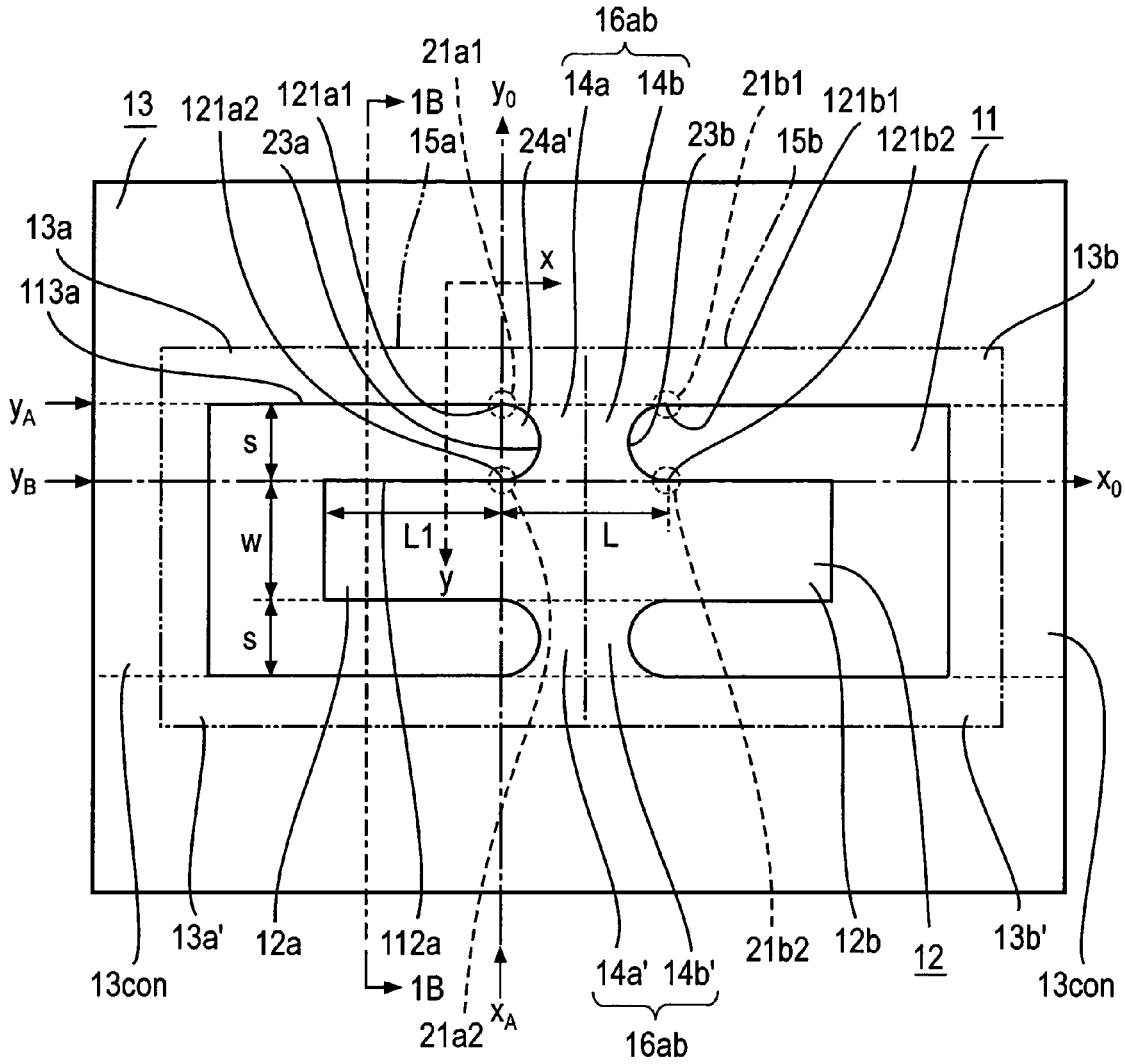
FIG. 1A shows a plan view of an embodiment 1 of the present invention.

FIG. 1A shows embodiment 1 of the present invention. In this embodiment, a pair of coplanar waveguide resonators 15*a* and 15*b* which share shorting ends 14*a* and 14*a*', and 14*b* and 14*b*' in common are coupled together by an inductive coupler 16*ab*. This embodiment 1 has the same degree of coupling between the two resonators as that of the conventional example of FIG. 12B. The resonators 15*a* and 15*b* of this embodiment each include a ground conductor connector 13*con* toward the open end of the center conductor so that each of them functions as a resonator in the similar manner as in FIG. 12B.

A distinction of this embodiment 1 over the conventional example resides in the fact that the shorting end 14*a* has an edge line 23*a* which joins between corner point 121*a*1 of corner area 21*a*1 formed between the ground conductor 13*a* and the shorting end 14*a* and corner point 121*a*2 of corner area 21*a*2 formed between the center conductor 12*a* and the shorting end 14*a* of the resonator 15, and which is a half-circular arc in configuration.

Specifically, the edge line 20*a* of the shorting end 14*a* which joins between two corner points 121*a*1 and 121*a*2 in the conventional coplanar waveguide resonator shown in FIG. 12B was a rectilinear line. However, the edge line 23*a* of the shorting end 14*a* in the coplanar waveguide resonator of the embodiment 1 shown in FIG. 1A is a half-circular arc having a diameter equal to a length between the two corner points 121*a*1 and 121*a*2. In accordance with the invention, the edge line 23*a* of the shorting end disposed toward the dielectric is also recessed into the shorting end by forming a cut portion 24*a*' of a half-circular arc configuration into the shorting end as shown in FIG. 1A.

As shown in FIG. 1A, a lateral edge 112*a* of the center conductor 12*a* which is located toward the dielectric exposed at the gap portion and is opposed to the ground conductor 13*a* is chosen as an $x_0$-axis, a straight line passing through corner points 121*a*1 and 121*a*2 where the shorting end 14 of the resonator 15*a* intersects with the center conductor 12*a* and the ground conductor 13*a* is defined as a $y_0$-axis, and a distance measured between a corner point 121*b*2 where the shorting end 14*b* of the resonator 15*b* intersects with the center conductor 12*b* and the corner point 121*a*2 on the resonator 15*a* (both located on the $x_0$-axis) is denoted by L.

A curve which is depicted by the edge line 23*a* of the shorting end 14*a* of the resonator 15*a* is expressed as follows:

$$x_0^2+(y_0-s/2)^2=(s/2)^2,\ 0\leqq x_0,\ 0\leqq y_0$$

Similarly, a curve depicted by the edge line 23*b* of the shorting end 14*b* of the resonator 15*b* is expressed as follows:

$$(x_0-L)^2+(y_0-s/2)^2=(s/2)^2,\ L-s/2\leqq x_0\leqq L,\ 0\leqq y_0$$

It is to be understood that each of the edge lines 23*a* and 23*b* is composed of and equivalent to a number of minimum length piecewise-linear straight lines which are consecutively disposed where an angle formed between a pair of adjacent minimum length straight lines is greater than 90°.

Figure 2:
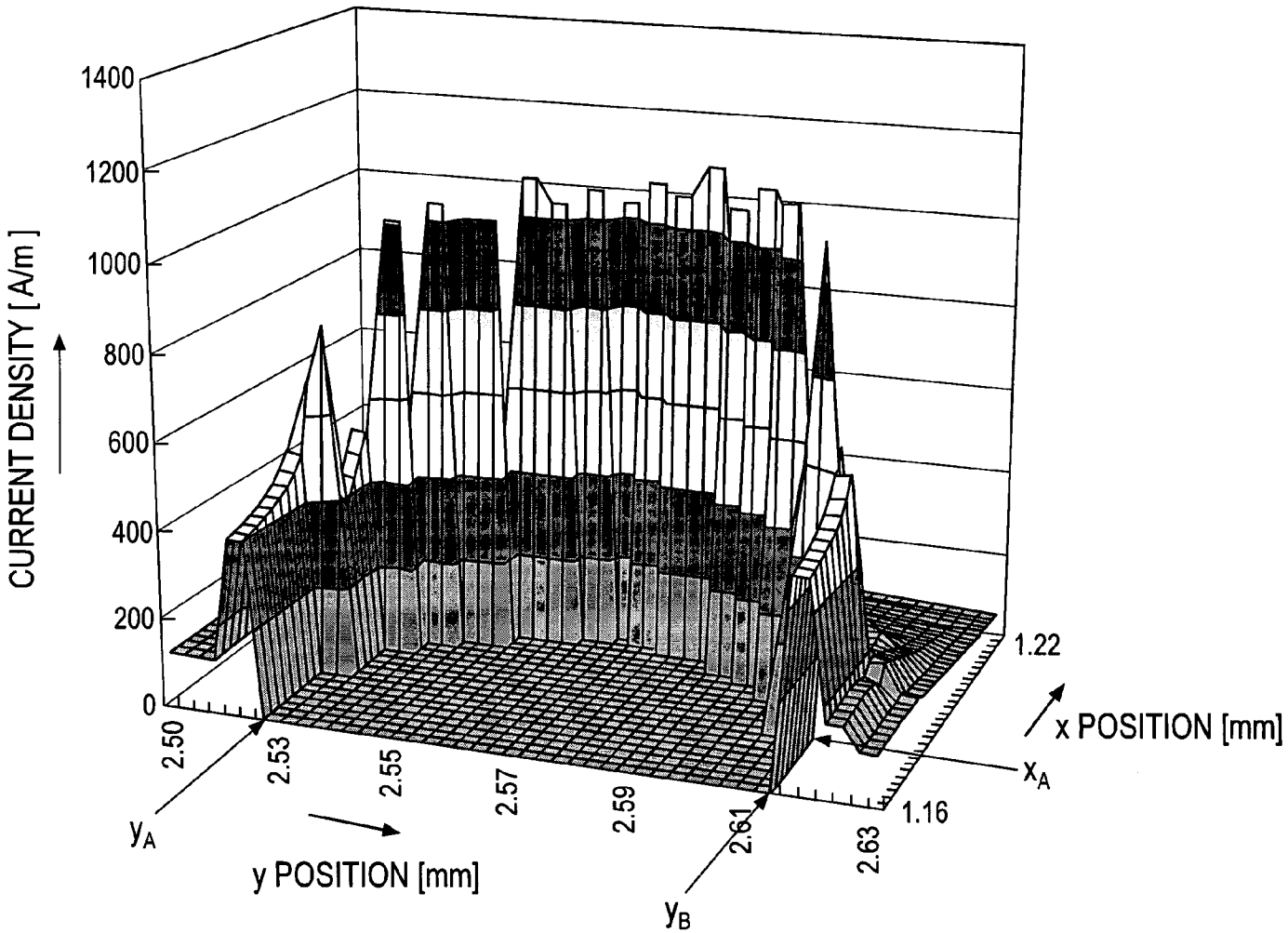
FIG. 2 graphically shows a current density distribution in the shorting end of the embodiment 1.

As compared respective angles of the corner areas 21*a*1, 21*a*2, 21*b*1 and 21*b*2 with the angle of 90° of the conventional example, the bend of the corner is more gentle to remove a corner point (or bend) substantially in the embodiment. Accordingly, the concentration of current at the corner points of the corner areas 21 is relieved. An example of a current density distribution calculated for the shortening end 14*a* of the embodiment 1 is illustrated in FIG. 2. Except for the use of the half-circular arc edge line 23*a* for the shorting end 14*a*, the calculation is made under the same conditions as for the conventional example of FIG. 12B. The x- and y-axis are located at the same positions as in FIG. 12B for the conventional example.

In FIG. 2, position $y_A$ on the y-axis corresponds to the position of the straight line 113*a*, position $y_B$ corresponds to the position of the straight line 112*a*, and position $x_A$ on the x-axis corresponds to the position of a straight line which joins between the corner points 121*a*1 and 121*a*2. As will be noted from this FIG. 2, the current density is generally flattened with the maximum current density value of 1130.3 A/m, and there are no high peaks at the corner points 121*a*1 ($x_A$, $y_A$) and 121*a*2 ($x_A$, $y_B$). By comparison with the current density distribution shown in FIG. 14 of the conventional example of FIG. 12B, it would be readily understood that the current density distribution is considerably reduced. Specifically, a maximum value of the current density is reduced by approximately 17%) as compared with FIG. 14. This means that a maximum value of the power is reduced by approximately 31%.

Figure 1B:
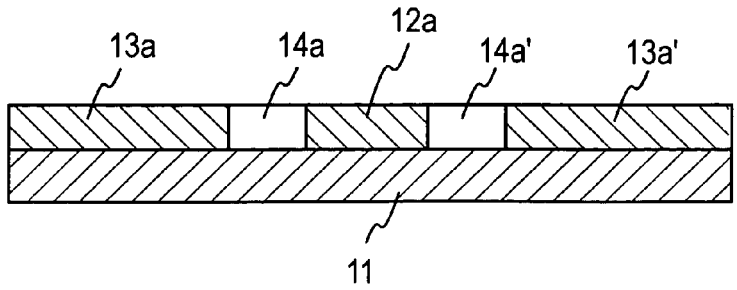
FIG. 1B is a cross section taken along the line 1B—1B shown in FIG. 1A.
Figure 3:
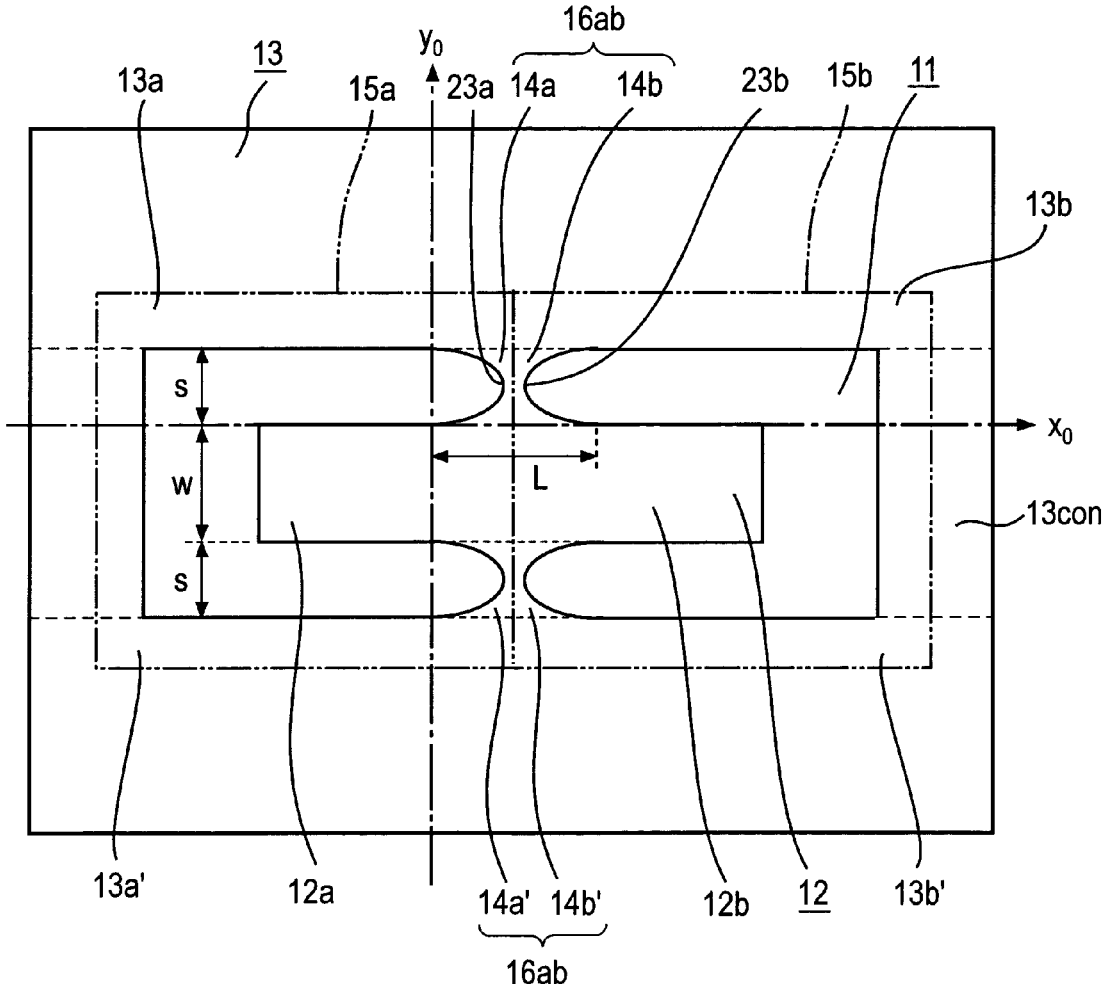
FIG. 3 is a plan view showing a modification of embodiment 1.

The configuration of the edge lines 23*a* and 23*b* of the shorting ends 14*a* and 14*b* may be chosen to exhibit a curvature which is greater or less than the curvature of a half-circular arc of a circle. An example having an increased curvature is shown in FIG. 3 where corresponding parts shown in FIG. 1 are designated as like reference characters as used therein without a specific description. The curvature of the edge lines 23*a* and 23*b* can be generally defined by a conical curve defined as follows:

$$ax_0^2+2bx_0y_0+cy_0^2+2dx_0+2ey_0+f=0$$

where a, b, c, d, e and f are arbitrary constants. Such conical surface may be obtained by cutting a surface of a cone by an arbitrary plane.

More generally, the edge lines 23*a* and 23*b* may be defined by any curve having a continuous differential coefficient and which is recessed into the shorting end with a condition that when a piecewise-linear approximation is used for the curve for the extent of the curved configuration is maintained, an angle formed between a pair of adjacent piecewise-linear straight lines be greater than 90°. This is true for subsequent embodiments.

In embodiment 1, a pair of coplanar waveguide resonators are disposed on a common dielectric substrate 11, but a single coplanar waveguide resonator or three or more coplanar resonators may be provided. This also applies to subsequent embodiments.

Embodiment 2

Figure 4A:
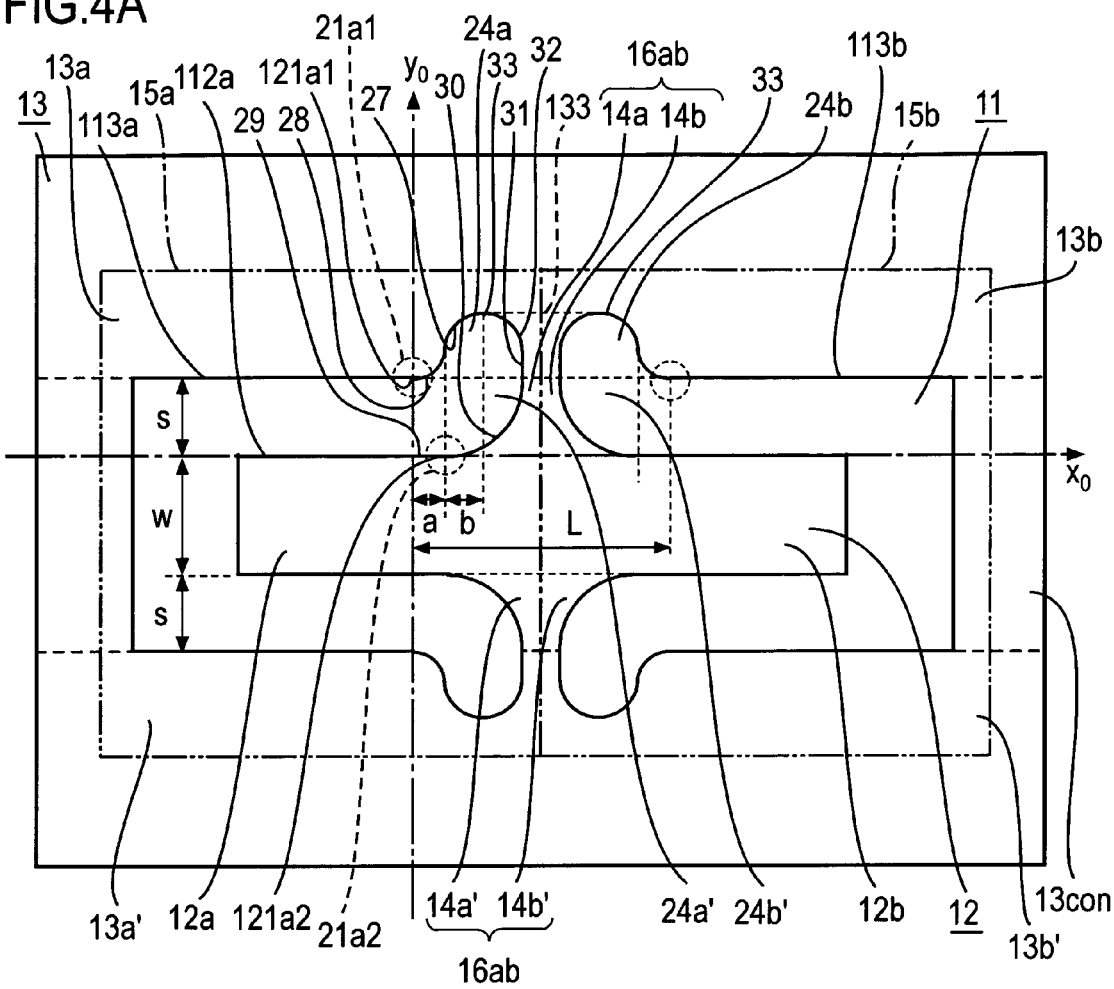
FIG. 4A is a plan view of embodiment 2 of the invention.

An example in which the degree of coupling between the coplanar waveguide resonators 15*a* and 15*b* in the embodiment 1 is increased is shown as embodiment 2 in FIG. 4A where corresponding parts to those shown in FIGS. 1A and 12B are designated by like reference characters as used before. Considering one of four shorting ends which constitutes a coupler 16*ab*, namely, shorting end 14*a*, it will be recalled that a straight line which joins a corner point 121*a*1 where this shorting end 14*a* is connected to the ground conductor 13*a* and a corner point 121*a*2 where the same shorting end 14*a* is connected to the center conductor 12*a* defines the edge line 20*a* in the conventional example shown in FIG. 12B and that a one-half circular arc of a circle with a diameter defined by a length 's=2b' of the above mentioned straight line defines the edge line 23*a* in the embodiment 1 shown in FIG. 1A.

In the present embodiment 2, a rectilinear edge line 29 having a length 'a' extends into the shorting end along the $x_0$-axis from the corner point of x0 and y0 axes to move the corner point 121*a*2, and is followed by an edge line 30 formed by a one-quarter circular arc of a circle with a diameter of length 's'. The edge line 30 continues to a straight edge line 31 vertically extending into the ground conductor 13*a*. The edge line 31 continues to edge lines 32 and 27, each formed by one-quarter circular arc of a circle with a diameter of the length 's=2b', which are in turn followed by an edge line 28 formed by one-quarter circular arc of a circle with a diameter of length '2a'. At its end, the edge line 28 connects to the corner point 121*a*1, thus completing the edge line of the shorting end 14*a*.

The thus obtained whole edge line of the shorting end 14*a* which is composed of edge lines 29, 30, 31, 32, 27 and 28 and which joins between the corner points 121*a*2 and 121*a*1 becomes longer than that of the embodiment 1 which is composed of a half of circular arc 23*a* of a circle with a diameter of the length 's'.

It will be noted that the straight edge line 29 and the edge line 30 are obtained by forming a cut portion 24*a*' recessing into the shorting end while the edge lines 31, 32, 27 and 28 are obtained by forming a cut portion 24*a* recessing into the ground conductor 13*a*.

As a result of providing the cut portions 24*a* and 24*a*' in the resonator 15*a* and the cut portions 24*b* and 24*b*' in the resonator 15*b*, the shorting ends 14*a* and 14*b* which are formed in common to function as an inductive coupler 16*ab* are considered to be extended at their ground conductor side ends into the ground conductors 13*a* and 13*b* from the straight lines 113*a* and 113*b* to straight line 133 which joins between point 33 which is a connection between the edge lines 32 and 27 of the resonator 15*a* and corresponding point 33 of the resonator 15*b*. As a result of providing the cut portions 24*a*, 24*a*' and 24*b*, 24*b*' in the resonators 15*a* and 15*b*, the length in $x_0$ direction of the inductive coupler 16*ab* is reduced.

Accordingly, the degree of coupling between the two resonators is increased.

Figure 4B:
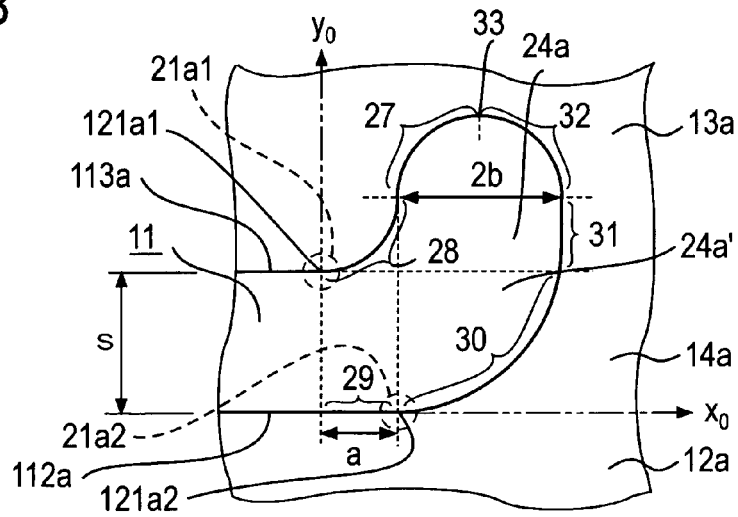
FIG. 4B is an enlarged view of one of shorting end with its edge line.

In the example 2 shown in FIG. 4A, these edge lines 29, 30, 31, 32, 27 and 28 are formed by arcs of circles. Part of FIG. 4A is shown to an enlarged scale in FIG. 4B.

The straight line 29 which represents an extension of an edge line 112*a* of the center conductor 12*a* toward the dielectric as well as one ground conductor 13*a* is a straight line defined by the following equation:

$$y_0=0,\ 0\leqq x_0\leqq a$$

where 'a' represents a distance between the point of origin of $x_0$ and $y_0$-axes and a corner point of the edge line toward the dielectric of the shorting end 14 located on the $x_0$-axis on.

The edge line 30 which continues from the edge line 29 is a one-quarter circular arc of a circle having a radius 's', and is defined by the following equation:

$$(x_0-a)^2+(y_0-s)^2=s^2,\ a\leqq x_0\leqq a+s,\ 0\leqq y_0\leqq s$$

The edge line 31 continuing from the edge line 30 and extending perpendicular to the center conductor 12 is a straight line represented by the following equation:

$$x_{0=a+s,\ s\leqq y0}\leqq s+a$$

The edge line 32 which continues from the edge line 31 as well as the edge line 27 which continues from the edge line 32 represent, respectively, a one-quarter circular arc of a circle having a radius of b, as defined by the following equations:

$$(x_0-(a+b))^2+(y_0-(s+a))^2=b^2,\ a+b\leqq x_0\leqq a+2b,\ s+a\leqq y_0\leqq s+a+b,\ b=s/2$$

$$(x_0-(a+b))^2+(y_0-(s+a))^2=b^2,\quad a\leqq x_0\leqq a+b,\quad s+a\leqq y_0\leqq s+a+b\quad b=s/2$$

where b represents a half of the width 's' of the cut portion 24*a*.

The edge line 28 which continues from the edge line 27 is one-quarter circular arc of a circle having a radius 'a', as expressed by the following equation:

$$x_0^2+(y_0-(s+a))^2=a^2,\ 0\leqq x_0\leqq a,\ s\leqq y_0\leqq s+a$$

It will be readily understood that with the embodiment 2, the degree of coupling between the coplanar waveguide resonators 15*a* and 15*b* can be enhanced and the concentration of the current density in the coupler 16*ab* can be suppressed.

Figure 5:
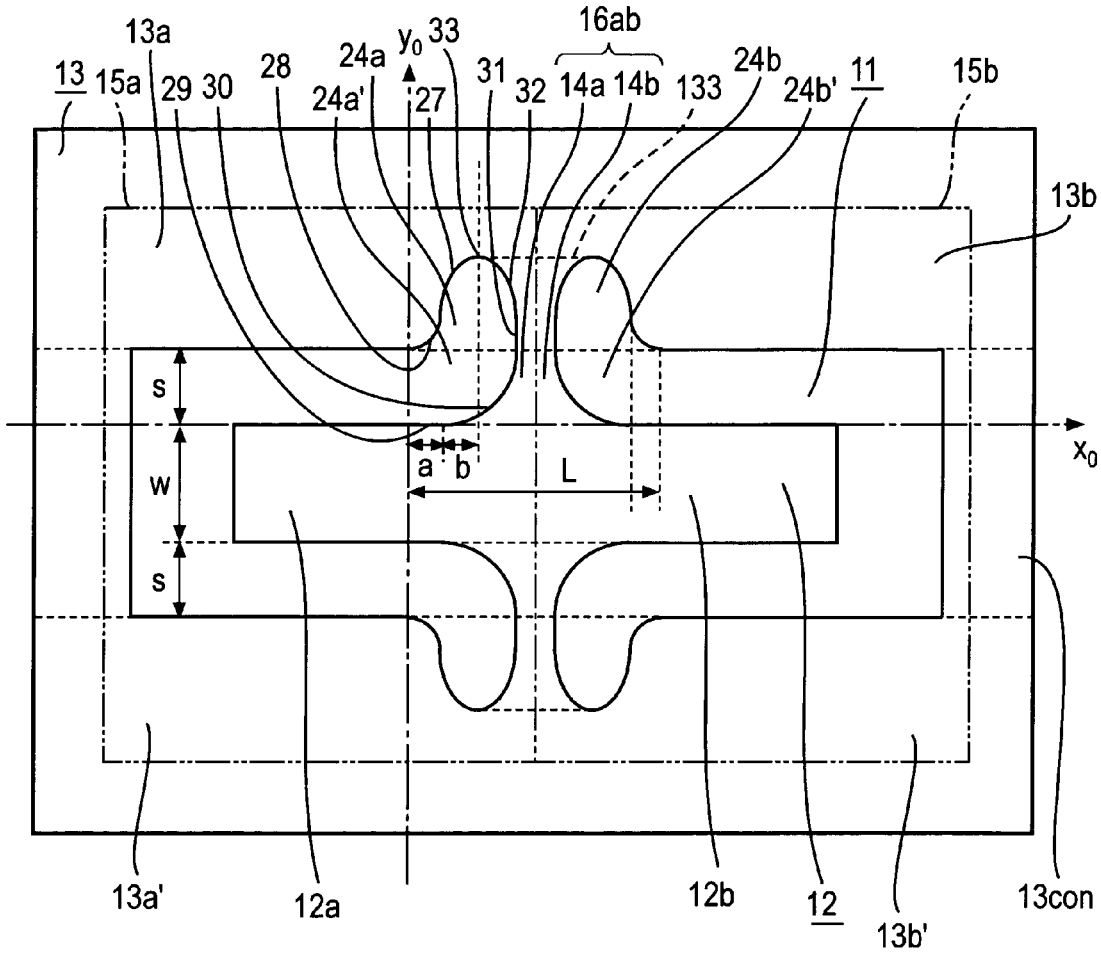
FIG. 5 is a plan view of a modification of embodiment 2.

When the degree of coupling between the coplanar waveguide resonators 15*a* and 15*b* is enhanced, and the corners are formed by edge lines which are defined by curves, the curves are not limited to a circular arcs of a circle as mentioned above, and a curvature can be chosen to be greater or less than the curvature of the circle. Such an example is illustrated in FIG. 5 where parts corresponding to those shown in FIG. 4 are designated by like reference characters as used in FIG. 4. In the example shown in FIG. 4, a continuation of the edge lines 32 and 27 toward the dielectric of the shorting end 14*a* which is obtained by formation of the cut portion 24*a* is chosen to be a half-circular arc of a circle, but in FIG. 5, the continuation of the edge lines has a greater curvature than the curvature of an arc of a circle of FIG. 4. Detailed description is omitted.

Embodiment 3

Embodiment 1 shown in FIG. 1A includes the shorting end 14*a* having the edge line formed by the one-half circular arc 23*a*. The one-half circular arc edge line has been described as comprising an innumerable number of piece-wise-linear minimal length straight lines which are consecutively connected together.

Embodiment 3 of the invention represents an arrangement in which an edge line of a shorting end 14*a* from a corner area 21*a*2 between a center conductor 12*a* and the shorting end 14*a* to the corner area 21*a*1 between a ground conductor 13*a* and the shorting end 14*a* comprises at least three straight lines which are consecutively connected together so that at least two or more corner areas are formed by adjacent two of these straight lines and are located such positions as recessed into the shorting end, with an angle formed at each corner area toward the dielectric between the two adjacent straight lines being greater than 90° and with the angle formed at the corner areas 21*a*2 and 21*a*1 also being greater than 90°.

Figure 6A:
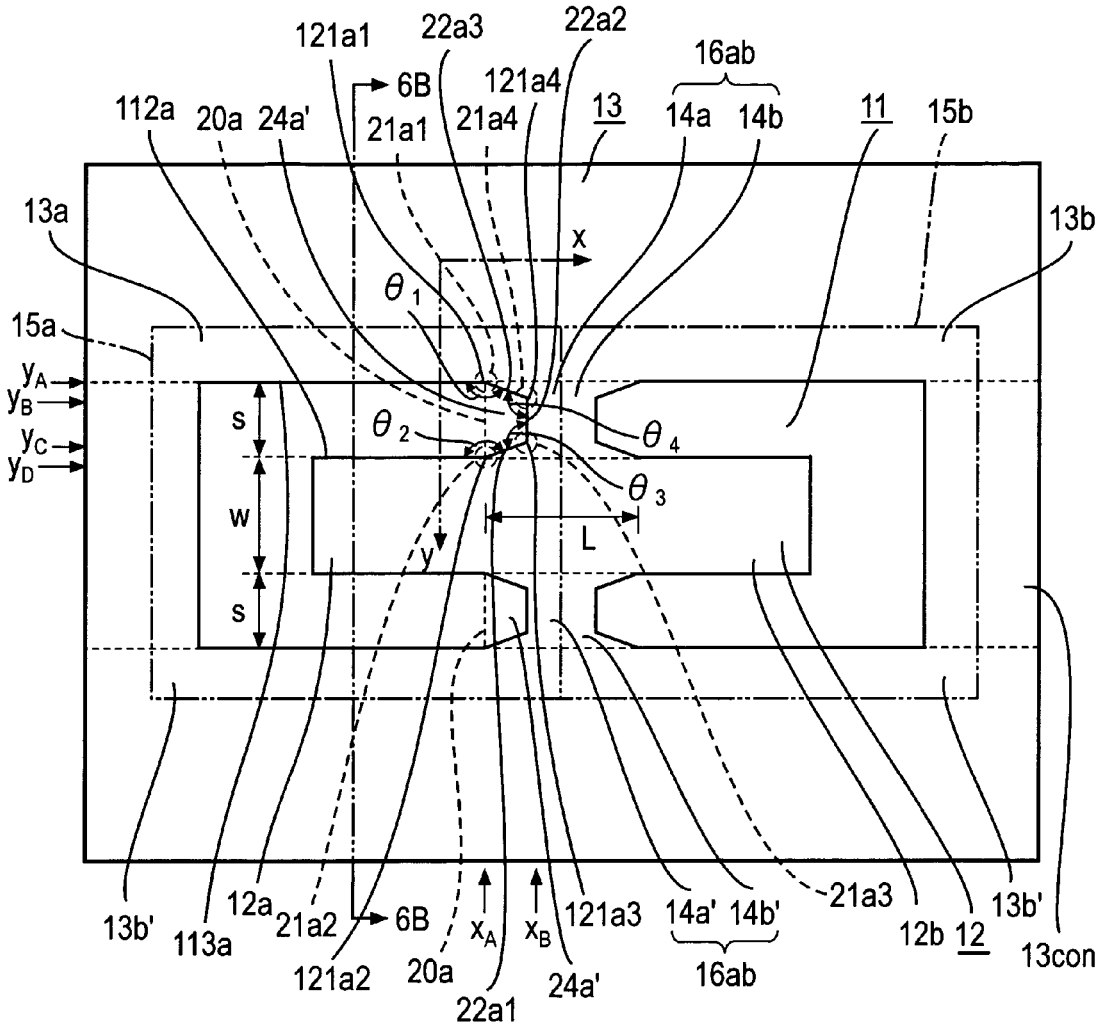
FIG. 6A is a plan view of embodiment 3 of the invention.
Figure 6B:
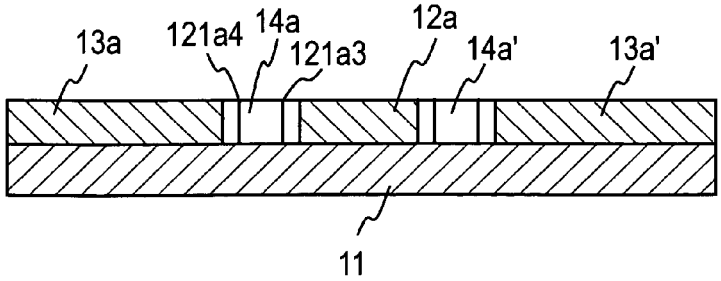
FIG. 6B is a cross section taken along the line 6B—6B shown in FIG. 6A.

FIG. 6 shows such an example. In this instance, a pair of coplanar waveguide resonators 15*a* and 15*b* share shorting ends 14*a* and 14*b* in common, which define a coupler 16*ab* to couple the both resonators. An edge line of the shorting end 14*a* from a corner area 21*a*2 between a center conductor 12*a* and shorting end 14*a* to a corner area 21*a*1 between a ground conductor 13*a* and the shorting end 14*a* comprises three straight lines 22*a*1, 22*a*2 and 22*a*3 which are consecutively connected together, and the edge line include two corner areas 21*a*3 and 21*a*4 in their consecutive connection.

Specifically, one end of the straight line 22*a*1 is connected with a straight line 112*a* which defines an edge line toward the dielectric of the center conductor 12*a* at a corner point 121*a*2 in the corner area 21*a*2 with an angle θ2 toward the dielectric which is greater than 90°, and the other end of the straight line 22*a*1 is connected with one end of the straight line 22*a*2 which is extended perpendicularly to the center conductor 12 at a corner point 121*a*3 in the corner area 21*a*3 with an angle θ3 toward the dielectric which is greater than 90°.

In addition, the other end of the straight line 22*a*2 is connected with one end of the straight line 22*a*3 at a corner point 121*a*4 in the corner area 21*a*4 with an angle θ4 toward the dielectric which is greater than 90°. The other end of the straight line 22*a*3 is connected with one end of a straight line 113*a* which represents an edge line toward the dielectric of the ground conductor 13*a* at a corner point 121*a*1 in the corner area 21*a*1 with an angle θ1 toward the dielectric which is greater than 90°.

The embodiment 3 comprises the edge line of the shorting end 14 which joins between the two corner points 121*a*1 and 121*a*2, and additionally, two corner points 121*a*3 and 121*a*4 are added to the edge line. When these corner points are added, there results a trapezoid. Accordingly, the edge line of this embodiment can be obtained by forming a cut portion 24*a*' which is trapezoidally recessed into the conventional edge line 20*a* of the shorting end.

Figure 14:
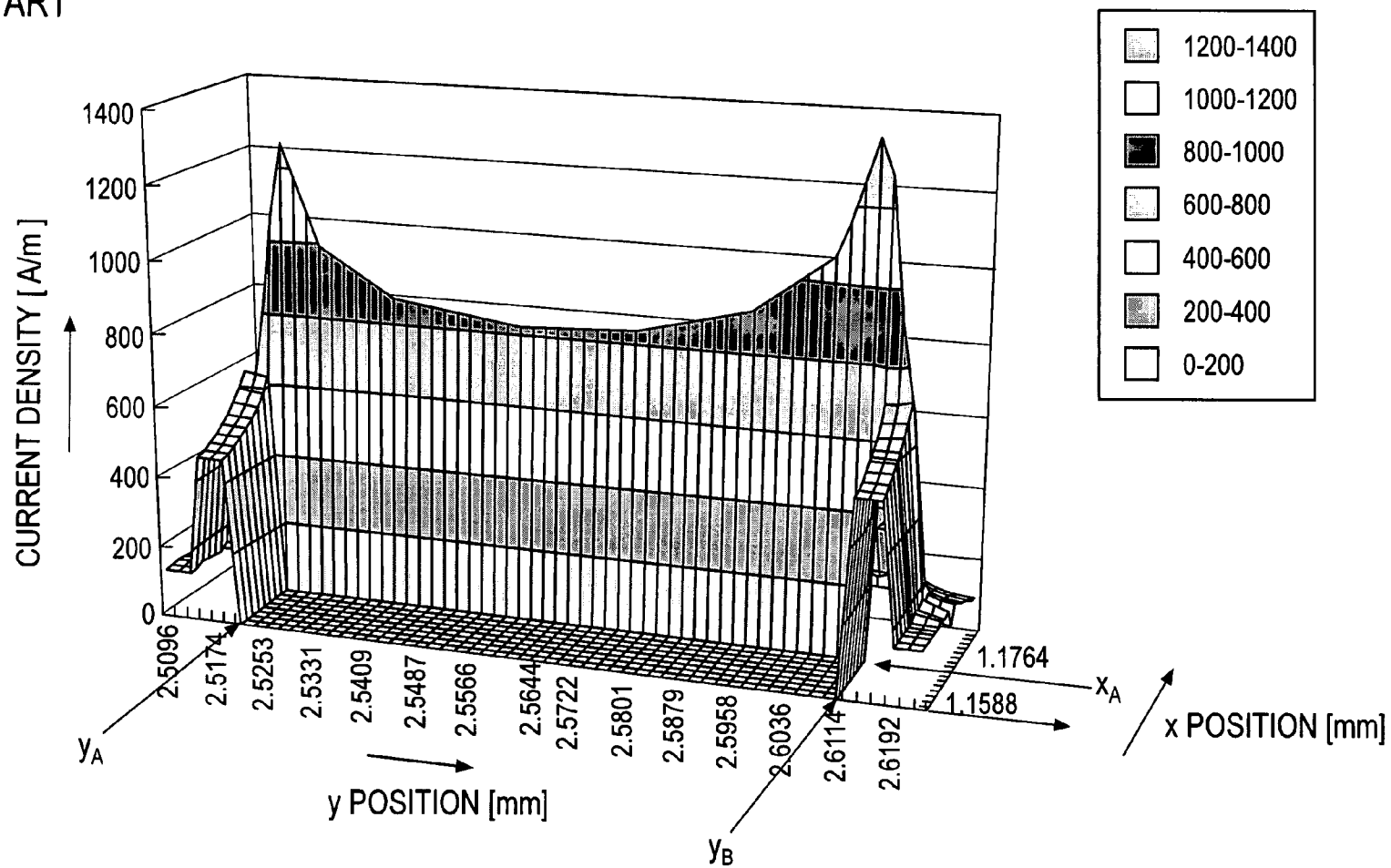
FIG.14 PRIOR ART
FIG. 14 graphically shows a current density distribution in the shorting end of the one conventional coplanar waveguide resonator shown in FIG. 12B.
Figure 15:
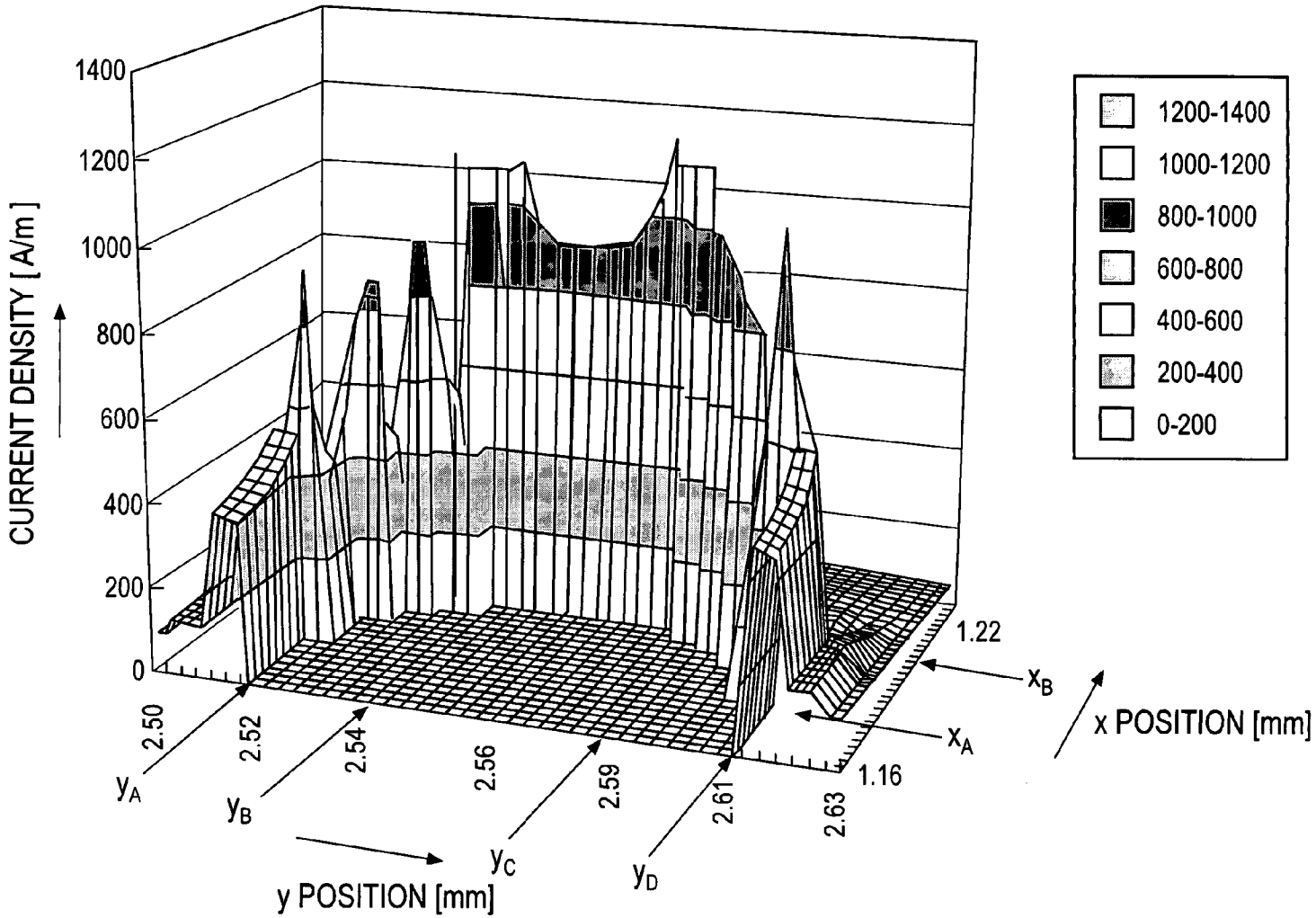
FIG. 15 graphically shows a current density distribution in the shorting end of embodiment 3.

When it is assumed in FIG. 6A that the straight lines 22*a*1, 22*a*2 and 22*a*3 which defined the edge line of the shorting end 14*a* have an equal length, it follows that θ1=θ2 and θ3=θ4. A current density distribution of the shorting end 14 is calculated under the same condition for other parameters as shown in FIG. 14, and the result is shown in FIG. 15. A maximum current density obtained is 1194.7 A/m. It is to be noted in FIG. 15 that position $y_A$ on the y-axis corresponds to the position of the straight line 113*a*, position $y_B$ corresponds to the position of the corner point 121*a*4, position $y_C$ corresponds to the position of the corner point 121*a*3 and position $y_D$ corresponds to the position of the straight line 112*a*, while position $x_A$ corresponds to the position of the corner points 121*a*1 and 121*a*2 and position $x_B$ corresponds to the position of the straight line 22*a*2 which joins between the corner points 121*a*3 and 121*a*4.

Upon comparison between the FIGS. 15 and 14, it will be readily apparent that the peaks in the current density of the embodiment are reduced in the corner area 21.

As would be understood from the embodiment 3, it is essential that a minimum angle among angles formed across four corner points, namely, either angle θ3 formed between the straight lines 22*a*1 and 22*a*2 or angle θ4 formed between the straight lines 22*a*2 and 22*a*3 in FIG. 6 be greater than 90°. On the basis of this, the concentration of the current density at the corner 21 should be reduced on the order of 1%, or preferably 5% or more (as compared to an arrangement having a straight edge line on the shorting end 14) and power be suppressed on the order of 2%, preferably 10%. This requirement depends on an equipment involved.

Embodiment 4

Embodiment 4 of the invention enhances the degree of coupling between coplanar waveguide resonators 15*a* and

Figure 7:
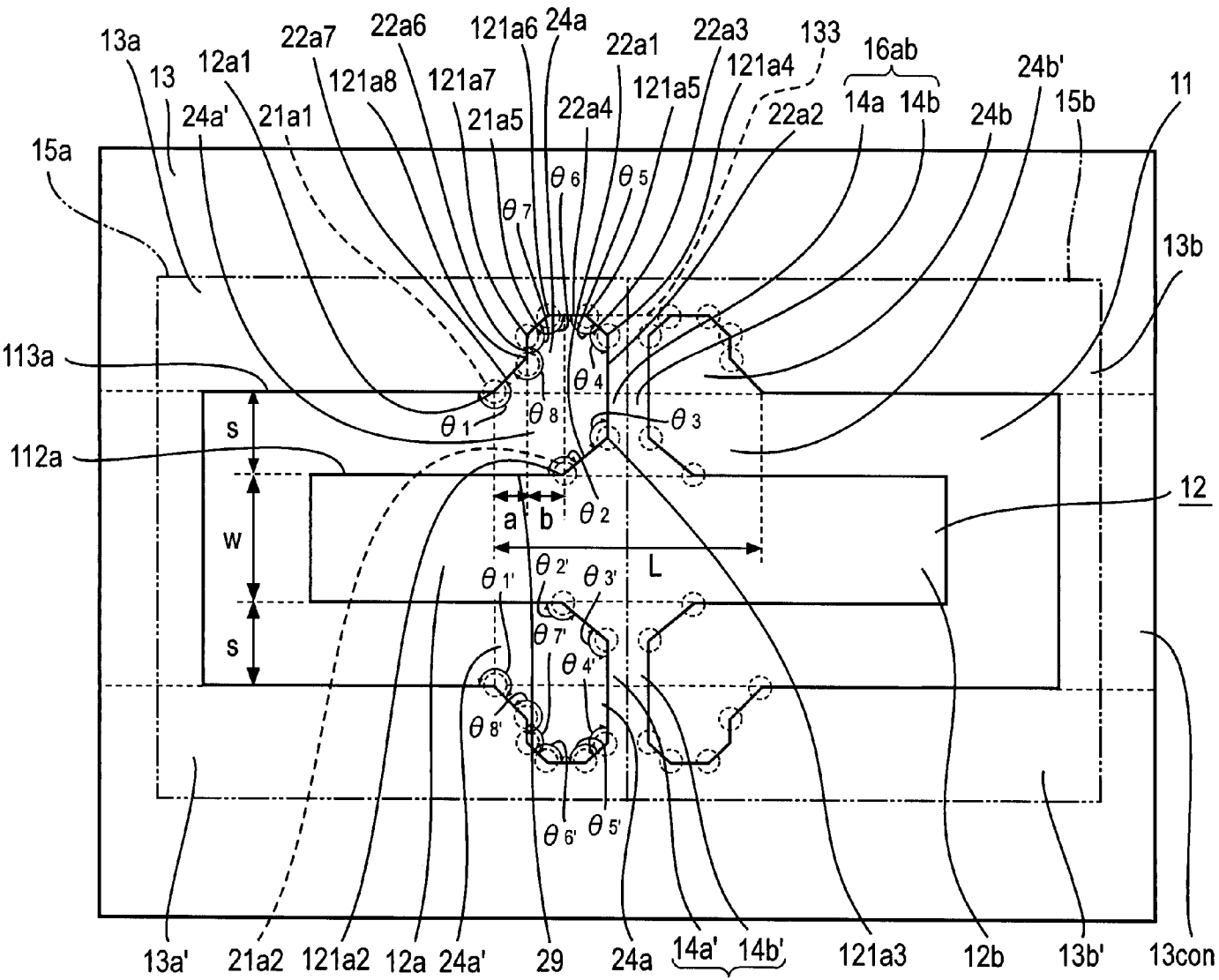
FIG. 7 is a plan view of embodiment 4 of the invention.

15*b* as in the embodiment 2 and employs a trapezoidally recessed edge lines for the shorting ends 14*a* and 14*b* as in the embodiment 3. Namely, the coupler 16*ab* is extended into the ground conductors 13*a* and 13*b* to reach the straight line 133 by forming the cut portions 24*a* and 24*b* in the ground conductors 13*a* and 13*b* and the coupler 16*ab* is shortened by forming the cut portions 24*a*' and 24*b*' in the shorting ends 14*a* and 14*b* to thereby enhance the degree of coupling. This embodiment 4 is shown in FIG. 7 where corresponding parts to those shown in FIGS. 4 and 6 are designated by like reference characters as used before.

The corner area 21*a*2 formed between the center conductor 12*a* and and the shorting 14*a* includes a corner point 121*a*2 and the corner area 21*a*1 formed between the ground conductor 13*a* and the shorting 14*a* includes a corner point 121*a*1. By forming the cut portion 24*a* in the ground conductor 13*a*, five corner points 121*a*4, 121*a*5, 121*a*6, 121*a*7 and 121*a*8 are obtained in the ground conductor 13*a*. By forming the cut portion 24*a*' in the shorting end 14*a*, the corner point 121*a*2 is shifted at one end of a straight line 29 and a corner point 121*a*3 is obtained. The straight lines 29 and 22*a*1 join together with an angle θ2 at the corner point 121*a*2, the straight lines 22*a*1 and 22*a*2 join together with an angle θ3 at the corner point 121*a*3, the straight lines 22*a*2 and 22*a*3 join together with an angle θ4 at the corner point 121*a*4, the straight lines 22*a*3 and 22*a*4 join together with an angle θ5 at the corner point 121*a*5, the straight lines 22*a*4 and 22*a*5 join together with an angle θ6 at the corner point 121*a*6, the straight lines 22*a*5 and 22*a*6 join together with an angle θ7 at the corner point 121*a*7, the straight lines 22*a*6 and 22*a*7 join together with an angle θ8 at the corner point 121*a*8, and the straight lines 22*a*7 and the edge line 113*a* of the ground conductor 13*a* join together with an angle θ1 at the corner point 121*a*1, to thereby form the edge line of the shorting end 14*a*, which forms a recessed trapezoid.

At any corner point, the angle θ formed between two adjacent straight lines should be set greater than 90° toward the dielectric. In the embodiment 4 also, the number of corner points and the angle formed between adjacent straight lines can be modified in the similar manner as in the embodiment 3.

Embodiment 5

Figure 18:
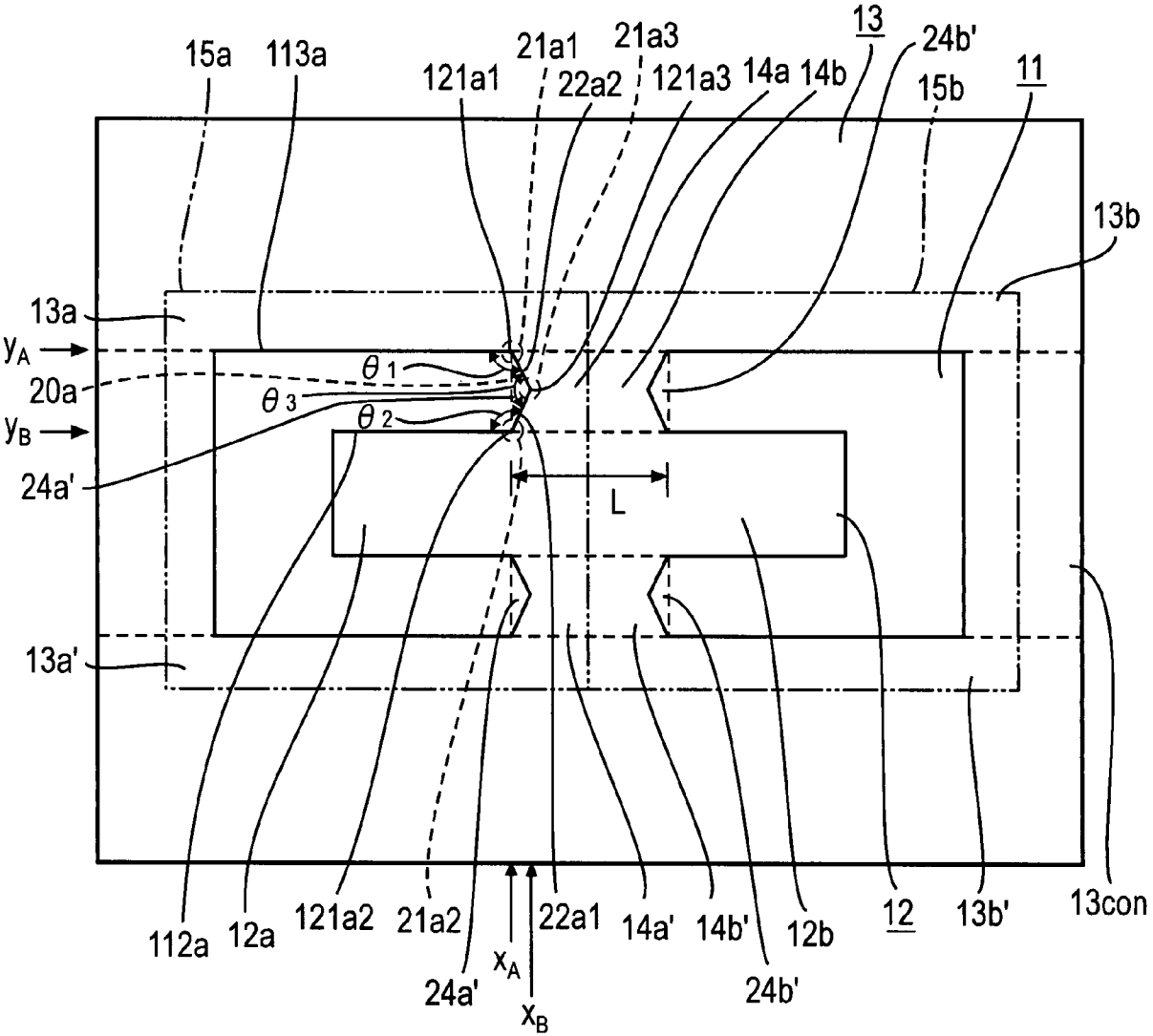
FIG. 18 is a plan view of embodiment 5.

As illustrated in FIG. 18, in an embodiment 5, the edge line for the shorting end 14*a* is recessed into a triangular configuration rather than a straight line as in the conventional example of FIG. 12B by forming a cut portion 24*a*' in the shorting end 14*a* to thereby obtain a corner point 121*a*3.

In the example shown in FIG. 18, at the corner point 121*a*1, a straight line 113*a* which represents an edge line of the ground conductor 13*a* toward the dielectric intersects with one end of a straight line 22*a*2 with an angle θ1. A straight line 112*a* which represents an edge line of the center conductor 12*a* toward the dielectric intersects with a straight line 22*a*1 at the corner point 121*a*2 with an angle θ2. The two straight lines 22*a*1 and 22*a*2 intersect at the corner point 121*a*3 with an angle θ3 to form a corner area 21*a*3.

Figure 19:
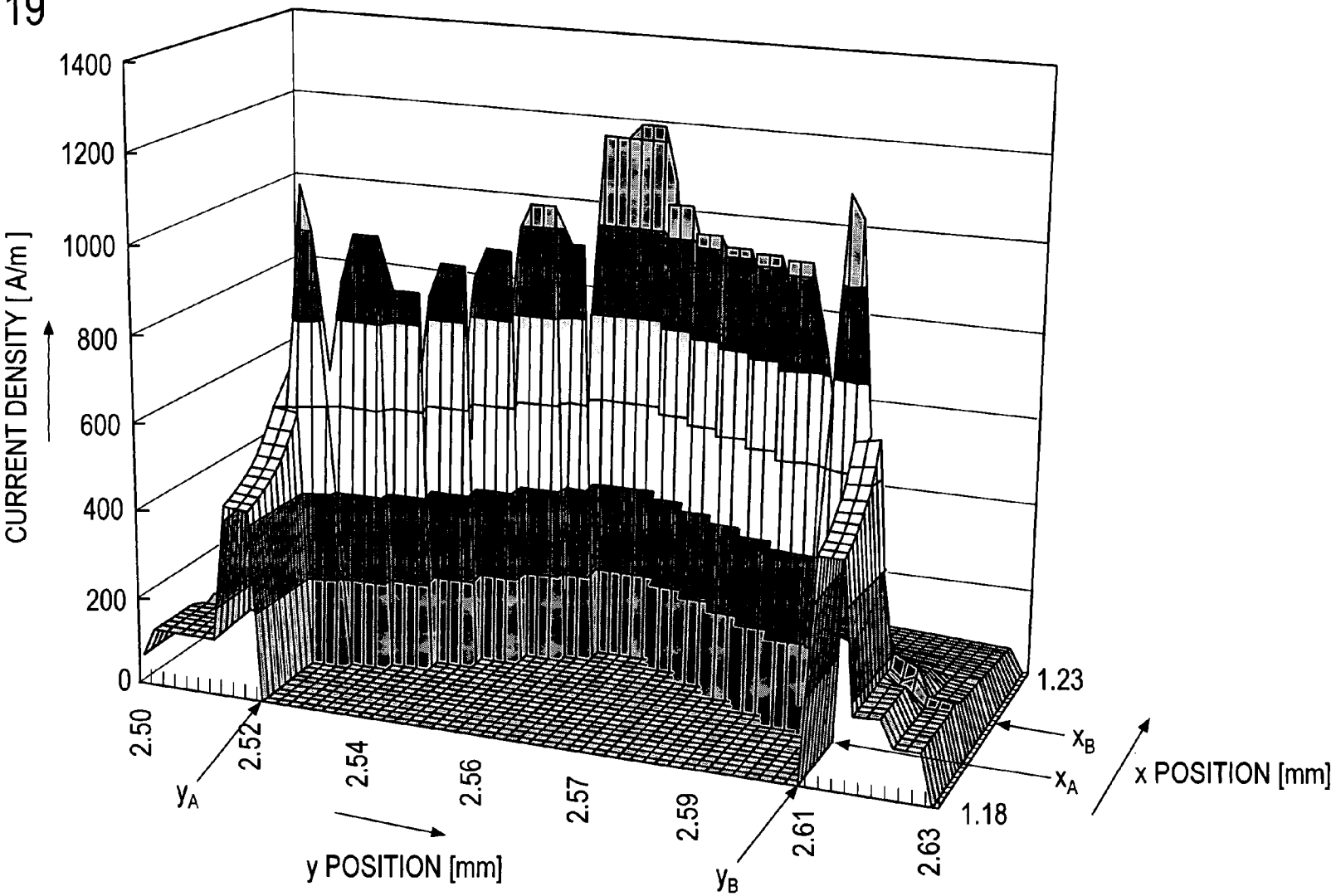
FIG. 19 graphically shows a current density distribution in the shorting end of embodiment 6.

An example of the current density distribution calculated for the case when the corner area 21*a*3 of the embodiment 5 has an obtuse angle θ3 in excess of 90° is shown in FIG. 19. The angle for this example is 120°. The conditions for the calculation remains the same as in the conventional example of FIG. 14 except that the shorting end 14*a* has a recessed edge line of a triangular configuration. x- and y-axis are positioned exactly in the same manner as in the conventional example of FIG. 12B.

As will be apparent from FIG. 19, a result of calculation yielded a maximum current density of 1236.6 A/m, and it is confirmed that peaks in the current density distribution of the shorting end 14 can be suppressed below the level of the prior art shown in FIG. 12B.

It is desirable that at all of the corner areas has an obtuse angle θ3 greater than 90°.

In FIG. 19, position $y_A$ on the y-axis corresponds to the position of the straight line 113*a*, position $y_B$ corresponds to the position of the straight line 112*a*, position $x_A$ on the x-axis corresponds to the positions of a the corner points 121*a*1 and 121*a*2 and position $x_B$ corresponds to the position of the corner point 121*a*3.

Embodiment 6

Figure 8:
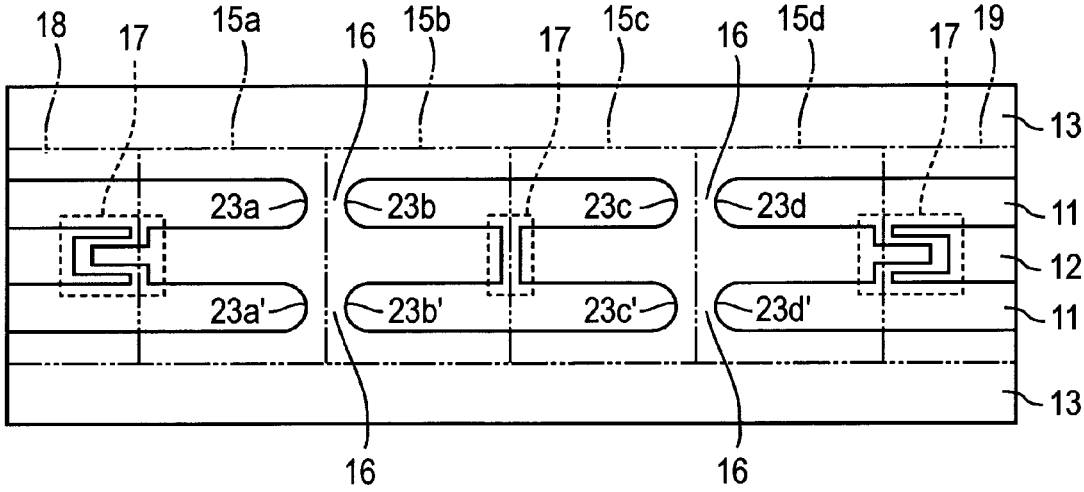
FIG. 8 is a plan view of embodiment 6 of the invention.

Embodiment 6 represents an application of the present invention to a plurality of coplanar waveguide resonators which constitute a filter arrangement. An example is shown in FIG. 8 where parts corresponding to those shown in FIGS. 1A and 12A are designated by like reference characters as used before. The example shown in FIG. 8 illustrates the application of the embodiment 1 shown in FIG. 1A to coplanar waveguide resonators forming a filter which is shown in FIG. 12. Duplicate description will not be given. It will be readily apparent that not only the embodiment 1, but either one of the embodiments 2–5 can also be applied to the coplanar waveguide resonators which constitute together such an filter. In each embodiment described above, the length L1 of the center conductor 12 is not limited to one-quarter wavelength, but may have any resonating electrical length with respect to the frequency used.

Other Embodiments and Applications

Figure 16A:
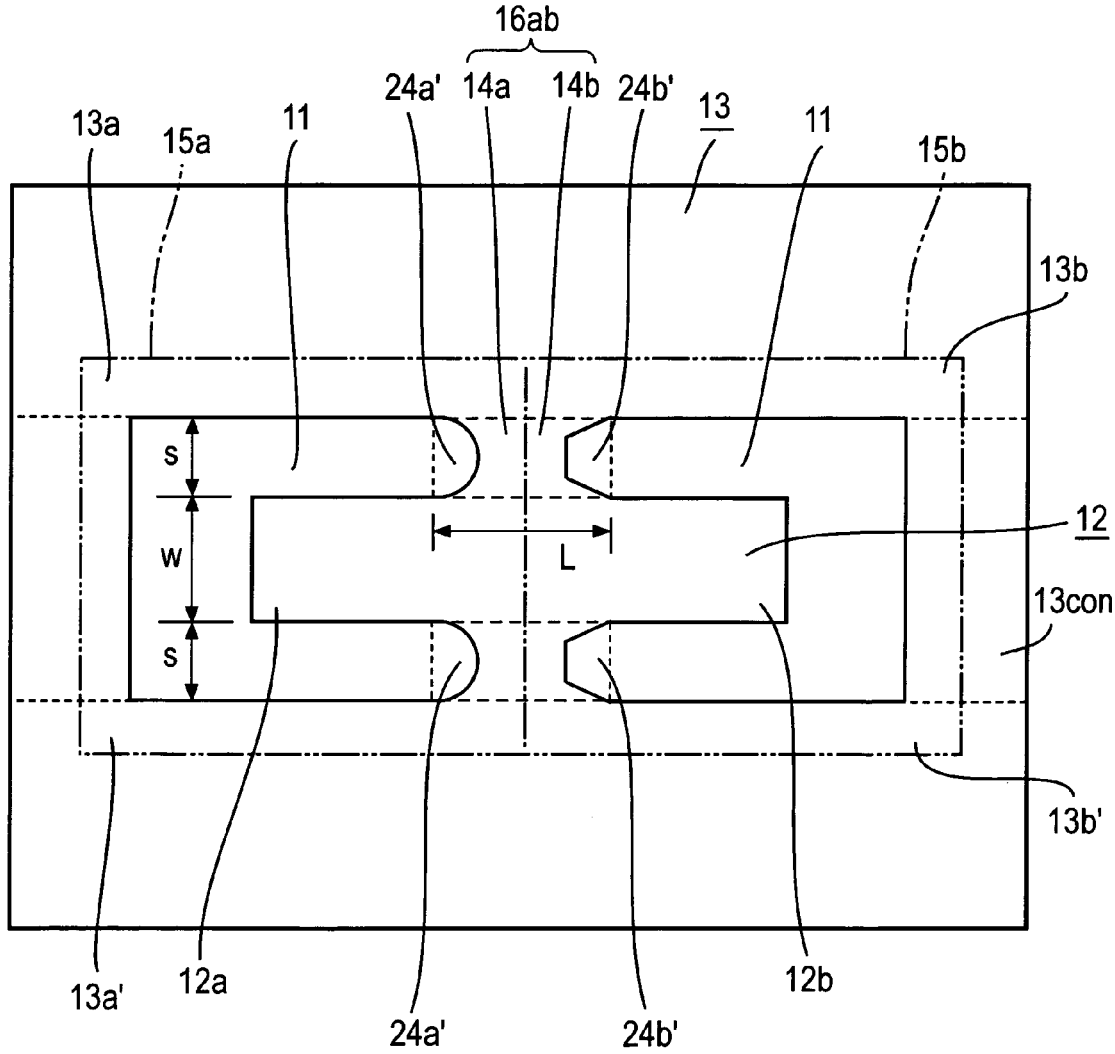
FIG. 16A is a plan view of an example of modifications of embodiments 1–5.

While the edge lines of the shorting ends 14*a* and 14*b* of the two resonators 15*a* and 15*b* have been described in the above embodiments as having symmetrical configurations, the invention is not limited thereto. For example, two of configurations shown in FIGS. 1A, 3, 4A, 5, 6A, 7 and 18 may be used in combination. An example is shown in FIG. 16A.

Figure 16B:
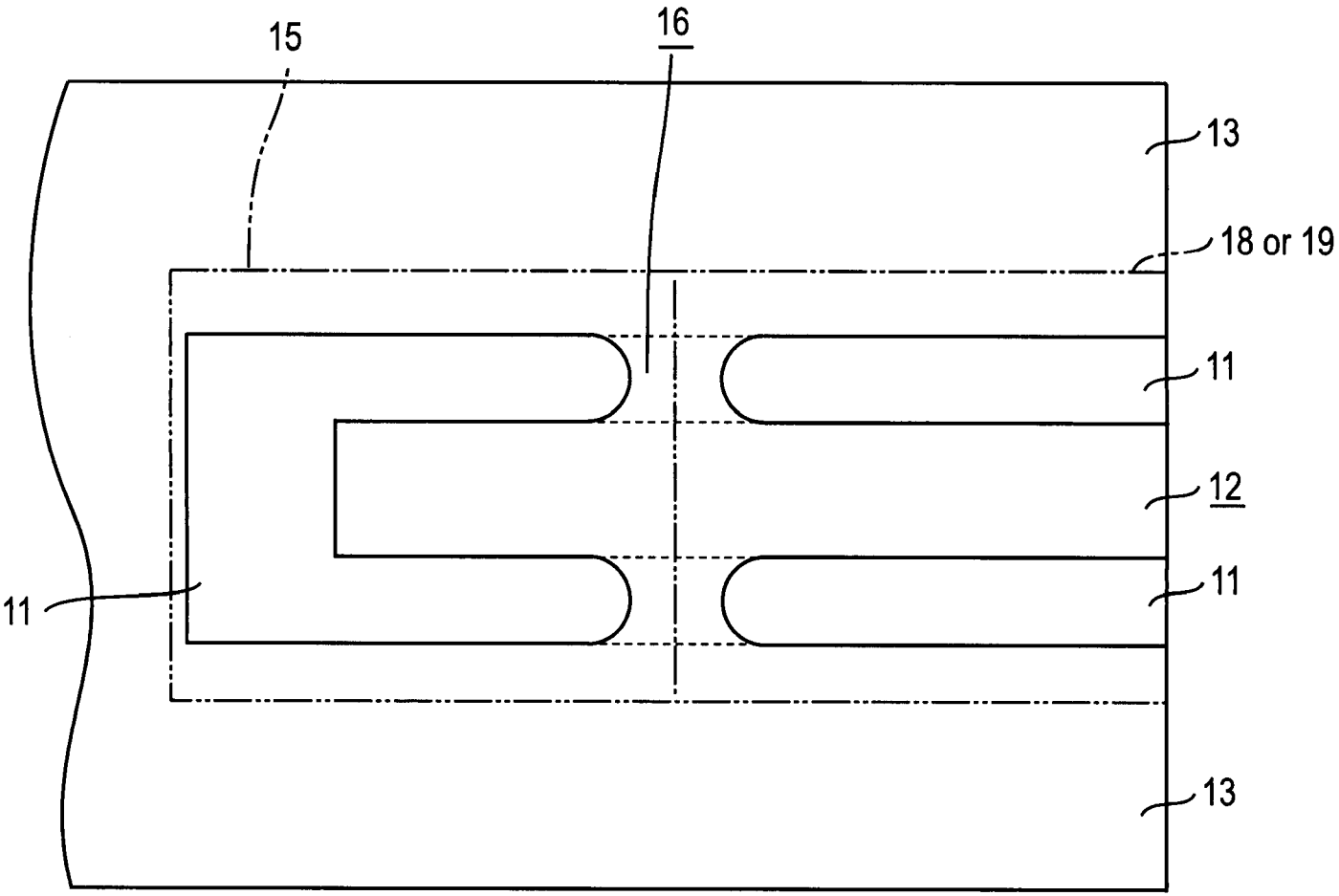
FIG. 16B is a plan view of an example in which the present invention is applied to an inductive coupler between a coplanar waveguide resonator and an input/output section.
Figure 16C:
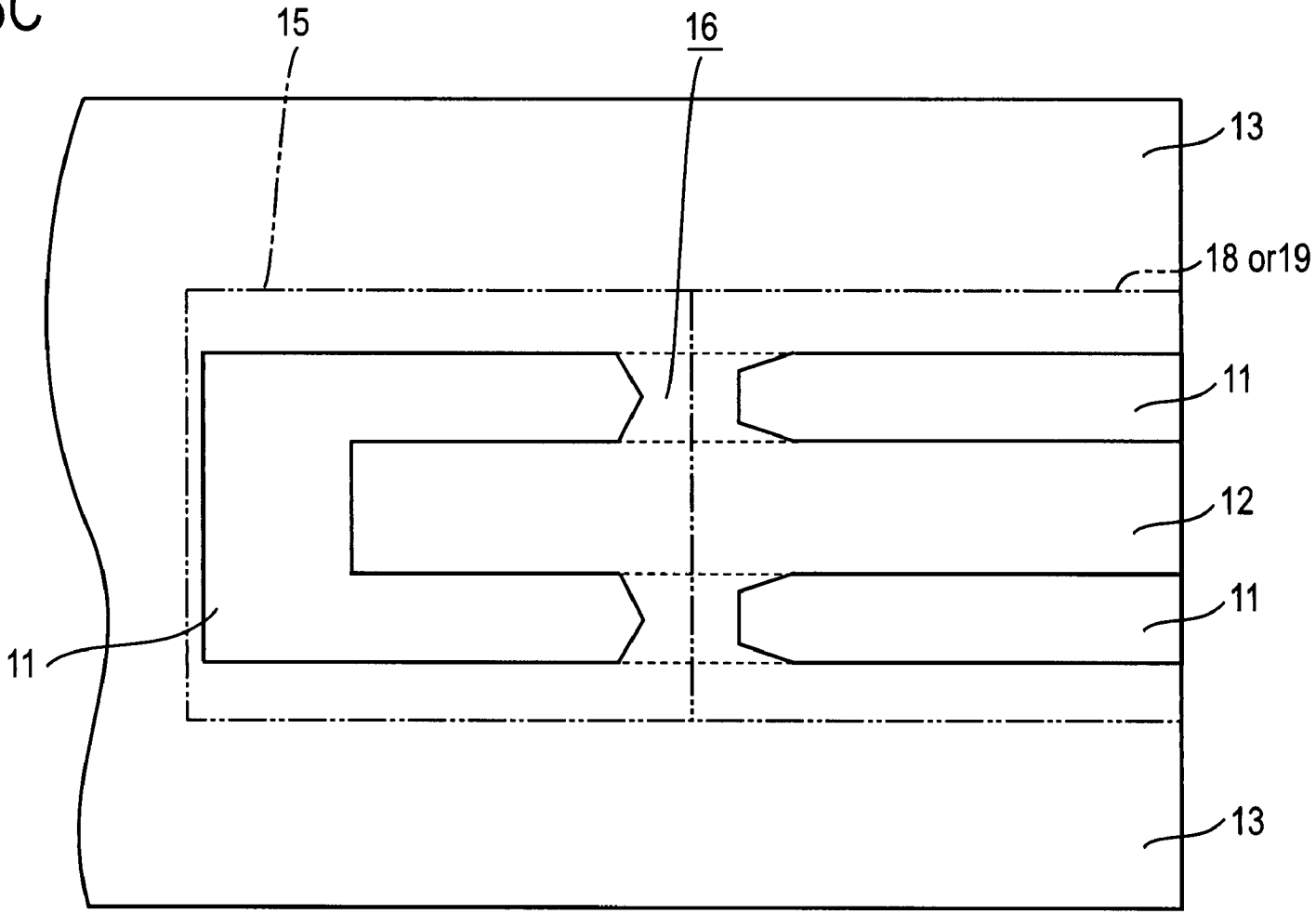
FIG. 16C is a plan view of a modification of FIG. 16B.

While the use of the inductive coupler 16 has been described in connection with the embodiment 1 to couple the coplanar waveguide resonator 15*a* and the coplanar waveguide resonator 15*b*, the invention is also applicable when the inductive coupler 16 is used to couple the coplanar waveguide resonator with the coplanar input section 18 and/or output section 19. FIG. 16B shows such an arrangement. The configuration of the edge line of one of the shorting ends of this coupler may be different from the configuration of the edge line of the other shorting end. FIG. 16C shows such an arrangement. A specific description is omitted.

Although the invention has been applied to embodiments 2 and 4 where the cut portions 24*a* and 24*b* are formed in order to increase the degree of coupling of the inductive coupler 16 between coplanar waveguide resonators, the invention is also applicable where cut portions 24 are formed in order to increase the degree of coupling of the inductive coupler 16 which is used between a coplanar waveguide resonator and a coplanar input and/or output section.

Figure 16D:
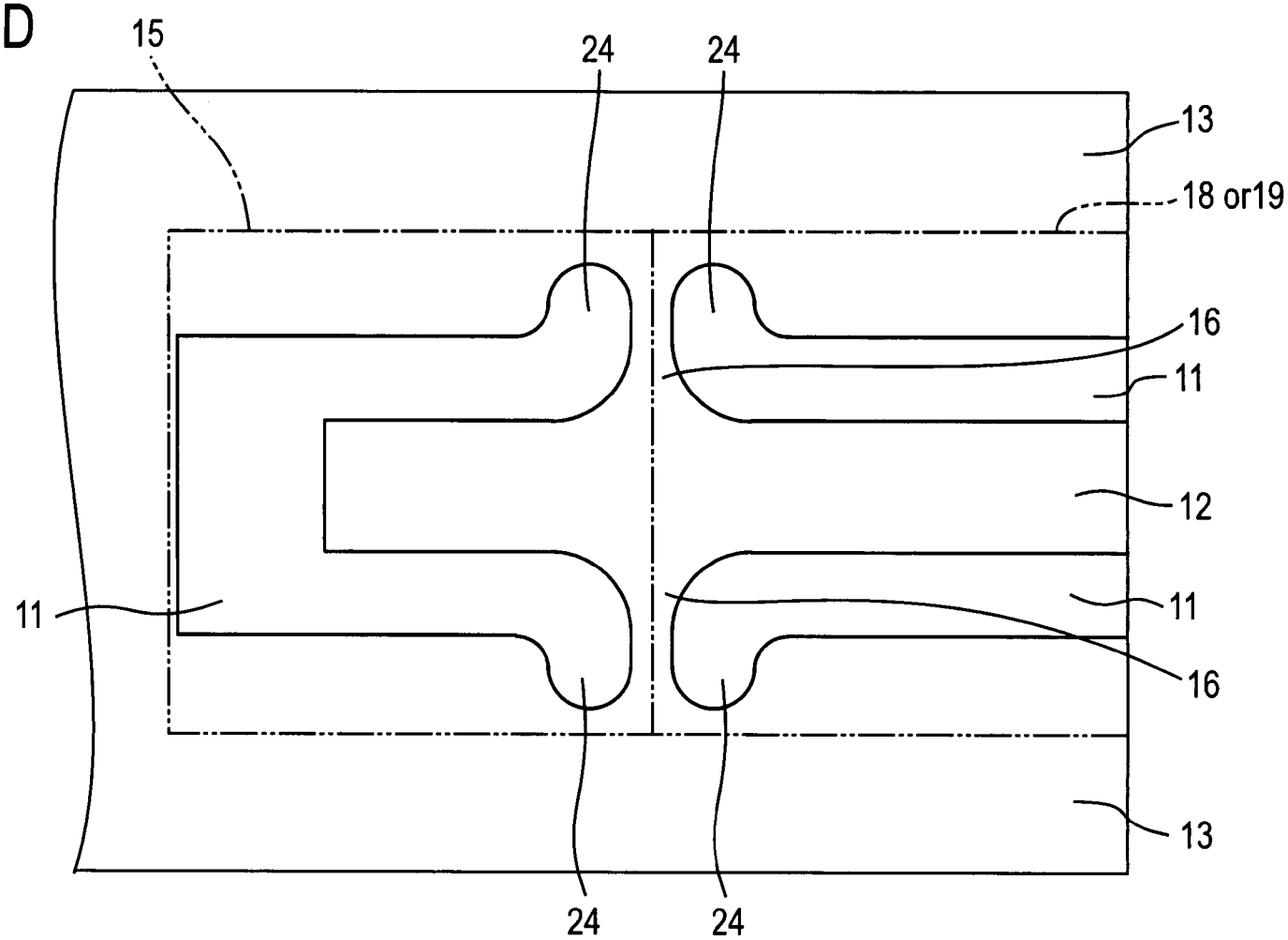
FIG. 16D is a plan view of another modification of FIG. 16B.
Figure 17:
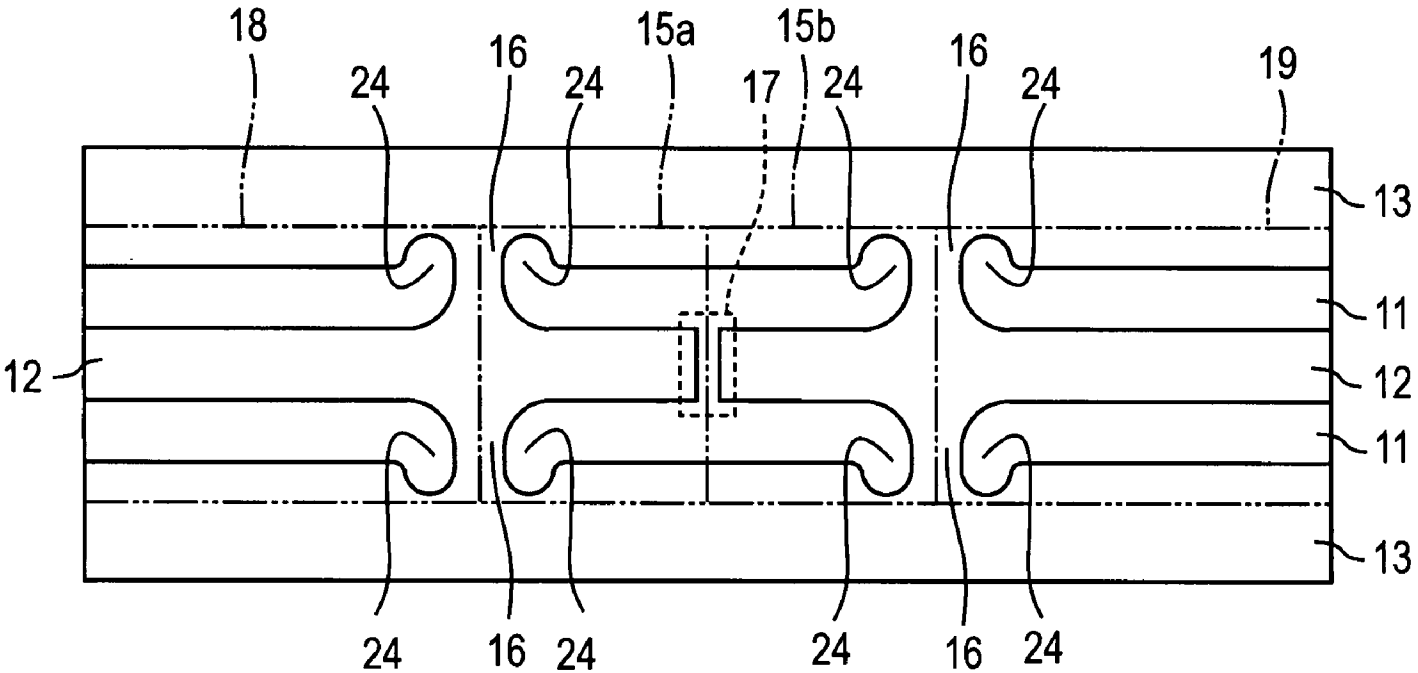
FIG. 17 is a plan view of an example in which the present invention is applied to a inductive coupler between an input and an output section of a coplanar waveguide resonator which is arranged to form a filter.

The application of the present invention to an inductive coupler 16 between a coplanar waveguide resonator and a coplanar input section 18 or output section 19 is shown in FIG. 16D, and the application of the present invention to an inductive coupler 16 between an input section and/or output section of coplanar waveguide resonators which constitute a filter is shown in FIG. 17, and in both these Figures, parts corresponding to those shown in FIGS. 4, 7 and 8 are designated by like reference characters as used before without repeating their description. In each of these instances, on the other side of a shorting end of a coplanar waveguide resonator according to the invention (which refers to the resonator 15 in FIG. 16D and to the resonator 15*a* or 15*b* in FIG. 17), a center conductor and a ground conductor are extended to form another coplanar input section 18 or coplanar output section 19.

More generally, within a single coplanar waveguide resonator, if a cut portion 24*a* is formed in the ground conductor 13*a* of the resonator 15*a*, the arrangement can be made as illustrated in FIGS. 4, 7 and 8.

Each coplanar waveguide resonator shown in the embodiments 1 to 6 has an obtuse angle in excess of 90° in any corner area and thus is capable of suppressing a concentration of the current density in a corner area, achieving a reduction in the power loss in a corresponding manner.

In the coplanar waveguide resonators of the embodiments 1 to 6, the center conductor 12, the ground conductor 13, the shorting end 14 and the coupler 16 can be formed of a superconducting material which assumes a superconducting state at or below a critical temperature to reduce the power loss in a drastic manner. At this end, a superconducting material having a critical temperature which is equal to or higher than 77.4° K which is the boiling point of liquid nitrogen may be used. High temperature superconductors of this kind include Bi, Tl, Pb and Y copper oxide superconductors, for example, any of which can be used in the present invention. When such a superconductor is used, a superconducting state is achieved by refrigerating it to a temperature on the order of 77.4° K. which is the boiling point for liquid nitrogen, for example, and accordingly, refrigeration capacity which is required for refrigerating means can be alleviated in order to achieve a superconducting state. If such a superconducting material is used, the application of the present invention allows a concentration of the current density to be reduced, thereby reducing the danger of destroy of the superconducting state due to flow in excess of a critical current during a large signal power input and allowing the low loss response of the superconductor to be fully taken advantages of.

Finally, when the conventional filter construction as shown in FIG. 12 is to be referred again, it is seen that the respective two resonators such as 15*a* and 15*b* constituting in pair therewith the inductive coupler 16*ab* do not always have the same current density at their corner areas 23*a* and 23*b*.

It is true that one of the pair resonators 15*a* and 15*b*, namely the resonator 15*a* which is positioned closer to the input section 18 than the other has a lower current density than that of the other.

This is also same as the other pair of the resonators 15*c* and 15*d* constituting the inductive coupler 16*cd*, so that the resonator 15*d* closer to the output section 19 than the other resonator 15*c* has a lower current density than that of the other resonator 15*d*. This means the resonators 15*b* and 15*c* to have a higher potential of danger to be destroyed than the other resonators 15*a* and 15*d*.

Accordingly it is considered more effective to apply the present invention to such the resonators 15*b* and 15*c*, while the other resonators 15*a* and 15*d* may have a conventional edge line.

Figure 20A:
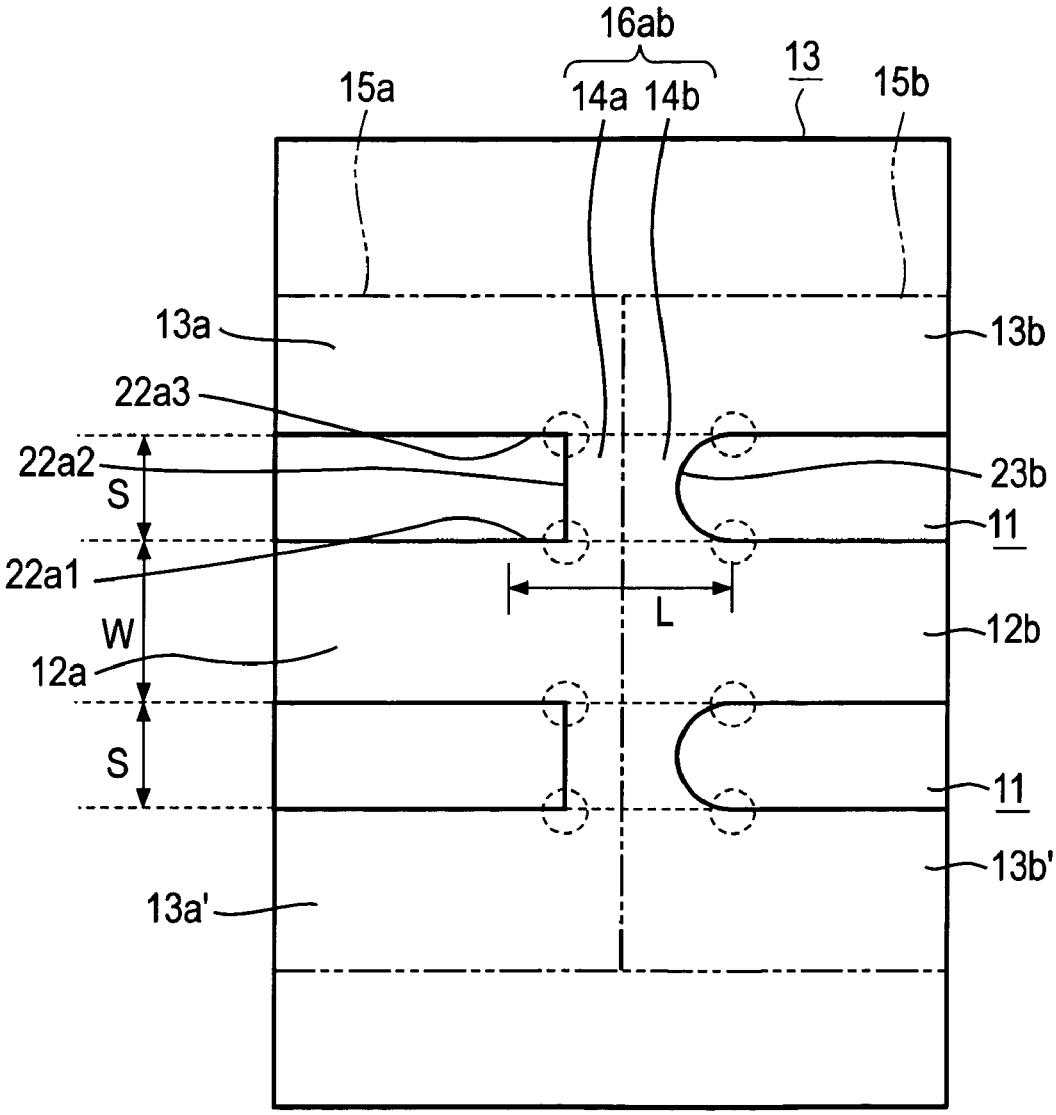
FIG. 20A shows another application example of the present invention.

One example of such the application of the present invention is shown in FIG. 20A wherein the resonator 15*b* is provided with the edge line 23*a* of a half-circular arc configuration while the other resonator 15*a* is provided with an edge line 20*a* which has two corner portions with an angle of 90°.

Figure 20B:
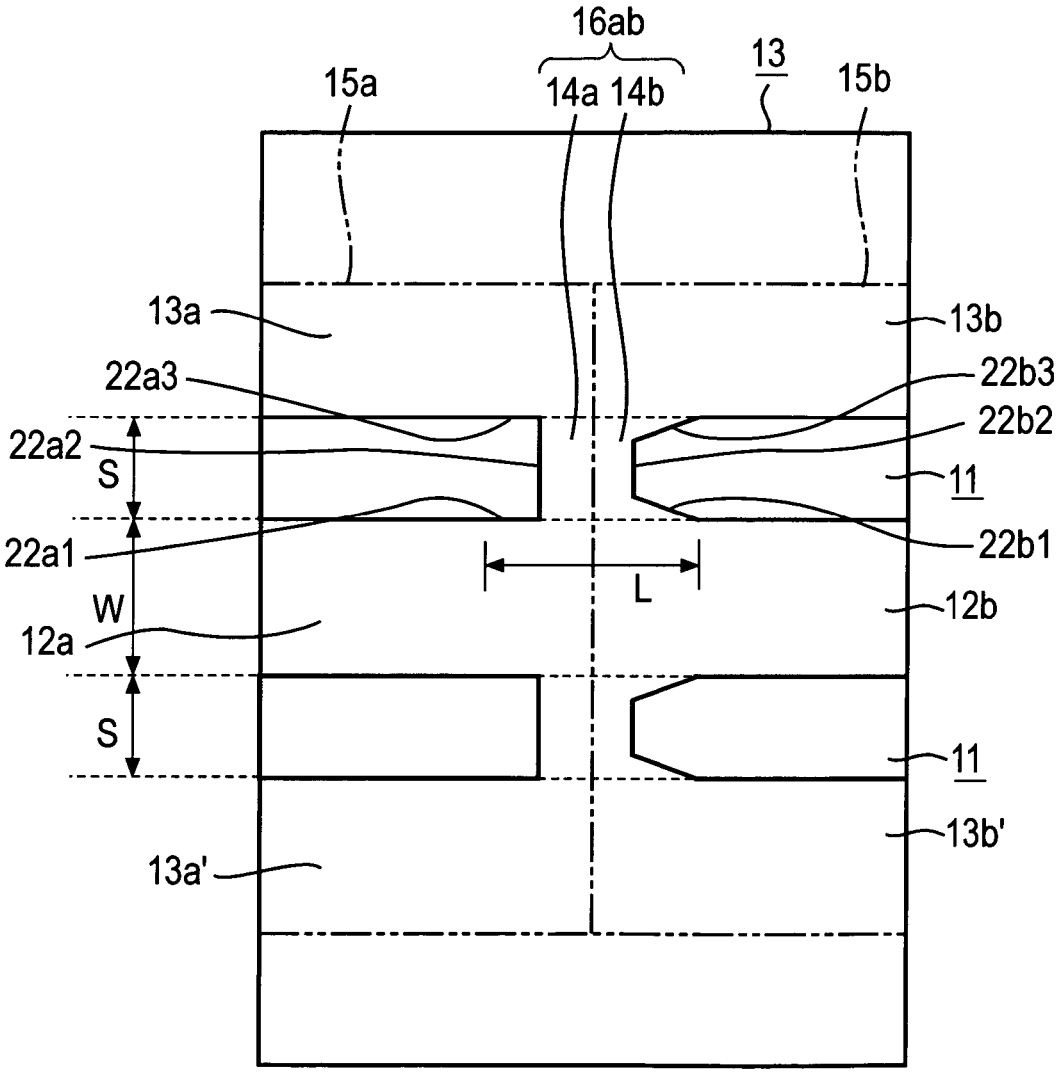
FIG. 20B shows a further application example.

Another example is shown in FIG. 20B wherein the resonator 15*b* is provided with the edge line of a quadrilateral or trapezoidally recessed configuration while the resonator 15*a* is provided with the straight edge line 20*a* which has two corner areas with an angle of 90°.

Figure 20C:
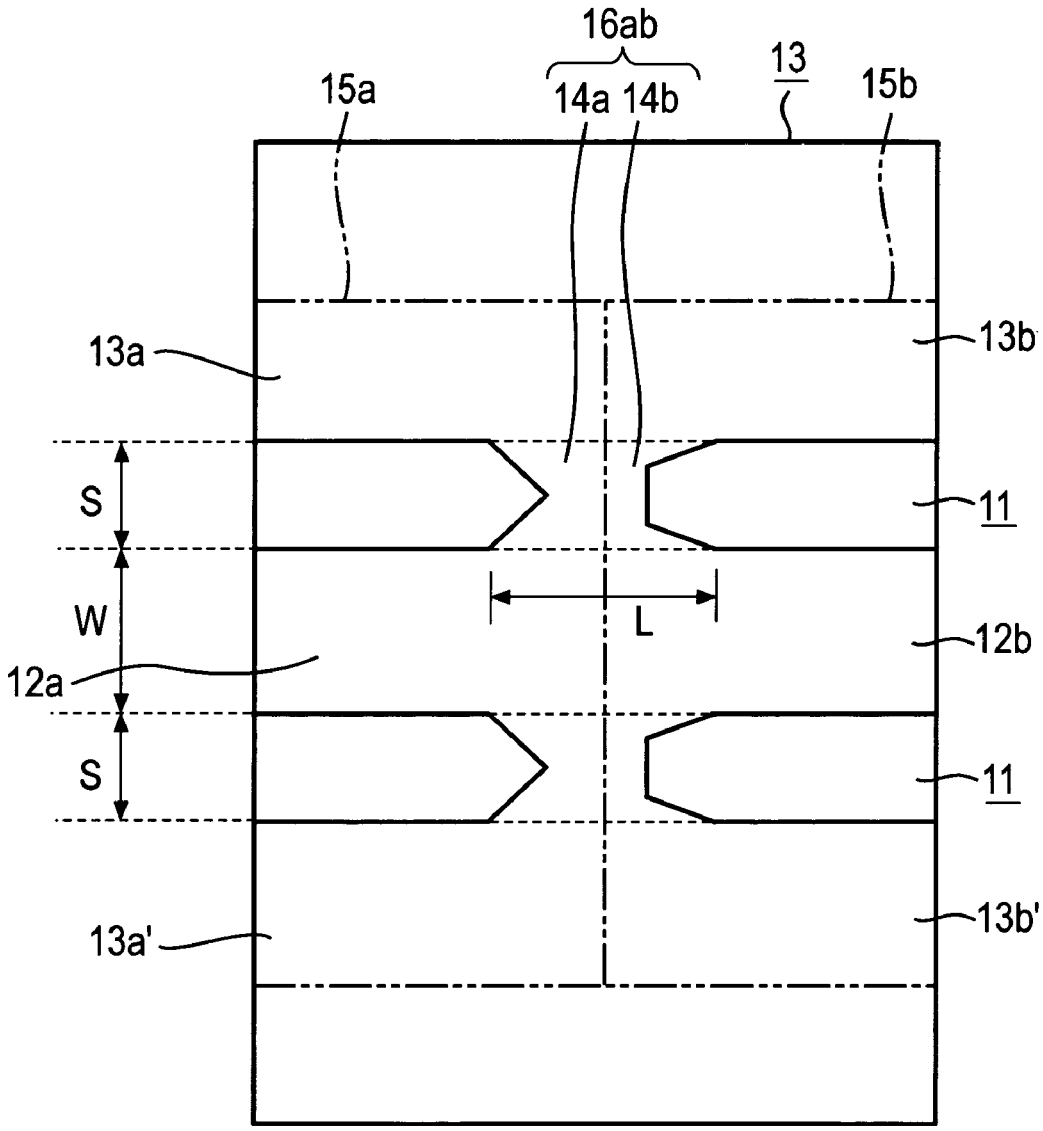
FIG. 20C shows a still further application example.

Further example is shown in FIG. 20C wherein the resonator 15*b* is provided with the edge line of a quadrilateral or trapezoidally recessed configuration while the resonator 15*a* is provided with the edge line of a triangular configuration.

According to these application examples, the filters thus obtained can get a current density reduction effect, so that it eliminates the danger of destroy of the superconductive condition much more than the conventional filter. It is also expected by these application example that the necessary time for computer simulation is much more shortened in compare to that required for the full simulation of the respective resonators with the invented edge lines of the half-circular arc configuration or the quadrilateral or trapezoidally recessed configuration.

MANNER OF ACTUAL USAGE OF THE PRESENT INVENTION

Figure 9:
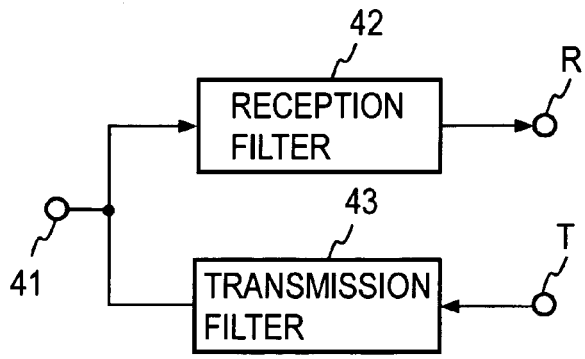
FIG. 9 is a block diagram showing an antenna duplexer.
Figure 10:
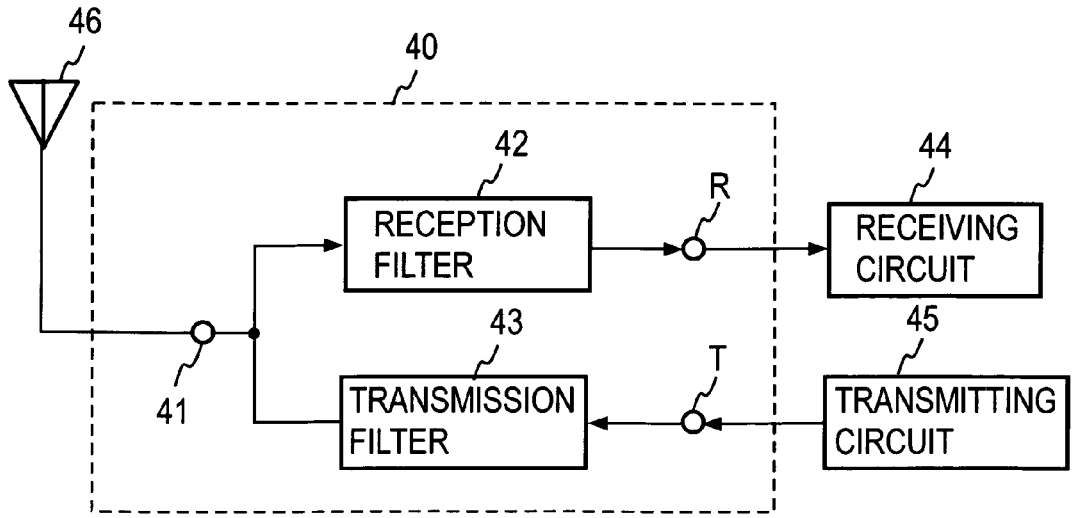
FIG. 10 is a block diagram showing a fundamental arrangement of communication equipment which includes the antenna duplexer.

As shown in FIG. 9, an antenna duplexer 40 may be constructed which allows a single antenna to be used in common for the transmission and the reception, by connecting a reception filter 42 which passes a reception frequency band and which blocks a transmission frequency band and a transmission filter 43 which passes a transmission frequency band and which blocks a reception frequency band to an antenna terminal 41. Coplanar resonators according to the inventions which form a filter may be used as such reception filter 42 and transmission filter 43. In this antenna duplexers, a receiving circuit 44 is connected to the reception terminal R, a transmitting circuit 45 is connected to the transmission terminal T, and an antenna 46 is connected to the antenna terminal 41, thereby forming a communication equipment. In this instance, when the coplanar waveguide resonators according to the invention which form a filter are used, a filter insertion loss can be reduced, allowing a high frequency transmitter-receiver of a communication unit to be achieved which is of a low insertion loss and a low noise level.

EFFECT OF THE INVENTION

Considering an edge line of each shorting end with respect to a center conductor and a ground conductor, a conventional example shown in FIG. 12B has two corner areas 21*a*1 and 21*a*2, the angle of which is equal to 90°.

By contrast, the present invention has two or more corner areas, 21*a*1, 21*a*2, 21*a*3,—and any corner area has an obtuse angle which is more gently angulated than 90°, allowing a concentration of the current density to be reduced in this region to reduce the power loss. Where conductors are formed with a superconducting material, the destruction of the superconducting state can be blocked for an equal input/output power.

As a summary, a comparison of the maximum current density for the conventional examples and according to the present invention is shown below.

| | edge line of shorting end | corre-sponding Figures | maximum current density (A/m) | reduction rate(%) referenced to conventional 1 |
|---|---|---|---|---|
| conventional 1 | straight line | FIGS. 12B & 14 | 1365.5 | — |
| invention 1 | Currilinear (polygonal) | FIGS. 1A & 2 | 1130.3 | 17.2 |
| invention 2 | quadrilateral | FIGS. 6A & 15 | 1194.7 | 12.5 |
| invention 3 | Triangular (obtuse angle) | FIGS. 18 & 19 | 1236.6 | 9.4 |

What is claimed is:

1. A coplanar waveguide resonator comprising:

a center conductor;

a pair of shorting stubs;

a pair of ground conductors; and a substrate made of a dielectric;

the center conductor, the shorting stubs and the ground conductors being disposed on the dielectric substrate in such a coplanar manner that the ground conductors are disposed on opposite sides of the center conductor with a gap portion therebetween where the dielectric is exposed, so that the ground conductors and the center conductor have edge lines toward the dielectric, and that the respective shorting stubs are disposed to connect the opposite sides of the center conductor at a position having a predetermined distance from an open end thereof to respective ground conductors resulting in forming corner areas that open toward the dielectric at junctions between each of said shorting stubs, said center conductor, and each of said ground conductors, so that each of said shorting stubs has an edge line toward the dielectric between the corner areas thereof, respectively;

wherein each of the corner areas is composed of two edge lines which are the edge line of the shorting stub and the edge line of the center conductor or the ground conductor, and the two edge lines are connected together at corner point of the corner area with an angle greater than 90° opening toward the dielectric.

2. The coplanar waveguide resonator according to claim 1, wherein the edge line of each of the shorting stubs is recessed into the shorting stub.

3. The coplanar waveguide resonator according to claim 1, wherein the edge line of each of the shorting stubs is recessed into one of the ground conductors.

4. The coplanar waveguide resonator according to claim 1, wherein the edge line of each of the shorting stubs is composed of at least two straight lines;

each of the two lines are connected together at one additional corner point with an angle toward the dielectric which is greater than 90°; and the one additional corner point with two lines is positioned and recessed into one of the shorting stubs.

5. The coplanar waveguide resonator according to claim 1, wherein the edge line toward the dielectric of each the shorting stubs is configured in a form of a curve.

6. The coplanar waveguide resonator according to claim 2, wherein the edge line of each of the shorting stubs is additionally recessed into one of the ground conductors.

7. The coplanar waveguide resonator according to claim 2, wherein the edge line of each of the shorting stubs is composed of at least two straight lines, each of the two straight lines are connected together at one corner point with an angle opening toward the dielectric which is greater than 90°, and the one corner point with two straight lines is positioned and recessed into one of the shorting stubs.

8. The coplanar waveguide resonator according to claim 6, wherein the edge line toward the dielectric of each of the shorting stubs is composed of at least two straight lines, each of the two straight lines are connected together at one corner point with an angle opening toward the dielectric which is greater than 90°, the one corner point with two straight lines is positioned and recessed into one of the shorting stubs, and another one corner point with two lines is positioned and recessed into one of the ground conductors.

9. The coplanar waveguide resonator according to claim 2, wherein the edge line toward the dielectric of each of the shorting stubs is configured in a form of a curve.

10. The coplanar wave guide resonator according to claim 6, wherein the edge line toward the dielectric of each of the shorting stubs is configured in a form of a curve.

11. A filter arrangement comprising:

a plurality of coplanar waveguide resonators, each of said waveguide resonators according to any one of claims 1 to 5, and 6 to 10 which are formed on the dielectric substrate and are successively coupled together through an inductive or capacitive coupler to perform a filter function.

12. A coplanar waveguide resonator arrangement comprising:

two coplanar waveguide resonators, each of said waveguide resonators according to any one of claims 1 to 5, and 6 to 10, the two coplanar waveguides having shorting stubs with a same edge line configuration, the two coplanar waveguide resonators are formed on the dielectric substrate, and the two coplanar waveguide resonators are successively coupled together through an inductive coupler.

13. A coplanar waveguide resonator arrangement comprising:

two said coplanar waveguide resonators, each of said two waveguide resonators according to any one of claims 1 to 5, and 6 to 10, the two coplanar waveguide resonators having shorting stubs with different edge line configurations, the two coplanar waveguide resonators are formed on the dielectric substrate, and the two coplanar waveguide resonators are successively coupled together through an inductive coupler.

14. A coplanar waveguide resonator arrangement comprising:

a coplanar waveguide resonator according to any one of claims 1 to 5, and 6 to 10; and a coplanar input or output section which is formed on the dielectric substrate and successively coupled together through an inductive coupler, said coplanar input or output section having shorting stubs with a same edge line configuration as that of the coplanar waveguide resonator.

15. A coplanar waveguide resonator arrangement comprising:

a coplanar waveguide resonator according to any one of claims 1 to 5, and 6 to 10; and a coplanar input or output section which is formed on the dielectric substrate and successively coupled to said coplanar waveguide resonator through an inductive coupler, said coplanar input or output section having shorting stubs with a different edge line configuration from that of the coplanar waveguide resonator.

* * * * *